US005660961A

United States Patent [19]

Yu

[11] Patent Number: 5,660,961

[45] Date of Patent: Aug. 26, 1997

[54] ELECTROPHOTOGRAPHIC IMAGING MEMBER HAVING ENHANCED LAYER ADHESION AND FREEDOM FROM REFLECTION INTERFERENCE

[75] Inventor: Robert C. U. Yu, Webster, N.Y.

[73] Assignee: Xerox Corporation, Stamford

[21] Appl. No.: 584,793

[22] Filed: Jan. 11, 1996

[51] Int. Cl.[6] ..... G03G 5/14

[52] U.S. Cl. ..... 430/58; 430/65

[58] Field of Search ..... 430/60, 61, 62, 430/63, 64, 65, 58

[56] References Cited

U.S. PATENT DOCUMENTS

| | | | |
|---|---|---|---|
| 4,579,801 | 4/1986 | Yashiki | 430/60 |
| 4,618,552 | 10/1986 | Tanaka et al. | 430/60 |
| 4,775,605 | 10/1988 | Seki et al. | 430/63 |
| 4,822,705 | 4/1989 | Fukagai et al. | 430/60 |
| 4,837,120 | 6/1989 | Akiyoshi et al. | 430/56 |
| 4,871,635 | 10/1989 | Seki et al. | 430/60 |
| 4,906,545 | 3/1990 | Fukagai et al. | 430/58 |
| 5,051,328 | 9/1991 | Andrews et al. | 430/62 X |
| 5,096,792 | 3/1992 | Simpson et al. | 430/58 |
| 5,139,907 | 8/1992 | Simpson et al. | 430/60 |
| 5,215,839 | 6/1993 | Yu | 430/58 |
| 5,372,904 | 12/1994 | Yu et al. | 430/64 |
| 5,378,566 | 1/1995 | Yu | 430/64 |
| 5,385,796 | 1/1995 | Spiewak et al. | 430/64 |
| 5,401,600 | 3/1995 | Aizawa et al. | 430/65 |

FOREIGN PATENT DOCUMENTS

0462439A1 12/1991 European Pat. Off. .

*Primary Examiner*—John Goodrow

[57] ABSTRACT

An electrophotographic imaging member including a substrate, a charge blocking layer, an optional adhesive interface layer, a charge generating layer, and a charge transport layer, the blocking layer comprising solid finely divided light scattering inorganic particles having an average particle size between about 0.3 micrometer and about 0.7 micrometer selected from the group consisting of amorphous silica, mineral particles and mixtures thereof, dispersed in a matrix material comprising the chemical reaction product of (a) a film-forming polymer selected from the group consisting of hydroxyalkylcellulose, hydroxy alkyl methacrylate polymer, hydroxy alkyl methacrylate copolymer and mixtures thereof and (b) an organosilane.

16 Claims, 5 Drawing Sheets

ELECTROPHOTOGRAPHIC IMAGING MEMBER HAVING ENHANCED LAYER ADHESION AND FREEDOM FROM REFLECTION INTERFERENCE

BACKGROUND OF THE INVENTION

The present invention relates to an electrophotographic imaging member having an improved charge blocking layer.

Typical electrophotographic imaging members comprise a photoconductive layer comprising a single layer or composite layers. One type of composite photoconductive layer used in xerography is illustrated, for example, in U.S. Pat. No. 4,265,990 which describes a photosensitive member having at least two electrically operative layers. The disclosure of this patent is incorporated herein in its entirety. One layer comprises a photoconductive layer which is capable of photogenerating holes and injecting the photogenerated holes into a contiguous charge transport layer. Generally, where the two electrically operative layers are supported on a conductive layer the photogenerating layer sandwiched between the contiguous charge transport layer and the supporting conductive layer, the outer surface of the charge transport layer is normally charged with a uniform charge of a negative polarity and the supporting conductive layer is utilized as an anode. The supporting conductive layer may also function as an anode when the charge transport layer is sandwiched between the supporting conductive layer and a photgenerating layer. The charge transport layer in this latter embodiment must be capable of supporting the injection of photogenerated electrons from the photoconductive layer and transporting the electrons through the charge transport layer.

As more advanced, complex, highly sophisticated, electrophotographic copiers, duplicators and printers were developed, greater demands were placed on the photoreceptor to meet stringent requirements for the production of high quality images. For example, the numerous layers found in many modern photoconductive imaging members must be uniform, free of defects, adhere well to adjacent layers, and exhibit predictable electrical characteristics within narrow operating limits to provide excellent toner images over many thousands of cycles. One type of multilayered photoreceptor that has been employed as a drum or belt in electrophotographic imaging systems comprises a substrate, a conductive layer, a charge blocking layer, an adhesive layer, a charge generating layer, and a charge transport layer. This photoreceptor may also comprise additional layers such as an overcoating layer. Although excellent toner images may be obtained with multilayered photoreceptors, it has been found that the numerous layers limit the versatility of the multilayered photoreceptor. For example, these photoreceptors often comprise a metal substrate having a roughened surface to avoid plywooding effects that can occur with laser exposure systems. It has been found that when drum substrates are dip coated, the charge blocking layer does not consistently form a thick uniform coating on the roughened surface and often leaves uncovered bare spots at the peaks of the toughened substrate surface. These bare spots directly impact copy print quality because they print out as white spot defects on negatively charged photoreceptors. Also, the charge blocking layer coating tends to spontaneously develop extensive layer cracking after drying at elevated temperatures used to facilitate curing. Cracks developed in charge blocking layers during cycling are manifested as print-out defects which adversely affected copy quality. Moreover, alteration of materials in the various photoreceptor layers such as the charge blocking layer can adversely affect overall electrical, mechanical and other electrophotographic imaging properties such as residual voltage, background, dark decay, adhesion and the like, particularly when cycled thousands or hundreds of thousands of times in environments where conditions such as humidity and temperature can change daily. Thus, there is a great need for mass produced dip coated photoreceptors exhibiting high quality and long service life.

In a flexible seamed electrophotographic imaging belt configuration, good adhesion bond strength at all the multilayered contacting interfaces is of crucial importance to assure physical/mechanical integrity of the imaging member belt as well as elimination of seam delamination problems which frequently develop due to the result of repeated fatigue belt cycling over small diameter belt support rollers and poor adhesion bond strength at the contacting interfaces of the charge blocking layer during image cycling. The application of a silane hole blocking layer in a typical flexible electrophotographic imaging member web by a solution coating process can lead to an inherent physical shortfall where a non-uniform coating layer thickness is formed due to the presence of islands of siloxane aggregates. The existance of these siloxane aggregates in the charge blocking layer has been determined to be as one of the major drivers which cause the development of charge deficient spots observed as defects in final print copies.

There are numerous applications in the electrophotographic art wherein a coherent beam of radiation, typically from a helium-neon or diode laser, is modulated by an image data input signal. The modulated beam is directed (scanned) across the surface of a photosensitive medium. The medium can be, for example, a photoreceptor drum or belt in a xerographic printer. Certain classes of photosensitive medium can be characterized as "layered photoreceptors" having at least a partially transparent photosensitive layer overlying a conductive ground plane. A problem inherent in using these layered photoreceptors, depending upon their physical characteristics, is an interference effect created by two dominant reflections of the incident coherent light on the surface of the photoreceptor; e.g., a first reflection from the top surface and a second reflection from the bottom surface of the relatively opaque conductive ground plane. Spatial exposure variations present in the image formed on the photoreceptor become manifest in the output copy derived from the exposed photoreceptor. The output copy exhibits a pattern of light and dark interference fringes which look like the grains on a sheet of plywood, hence the expression "plywood effect" is generically applied to this problem. This phenomenon will be described in greater detail hereinafter.

INFORMATION DISCLOSURE STATEMENT

U.S. Pat. No. 5,215,839 to Yu, issued Jun. 1, 1993—A layered imaging member is disclosed which is modified to reduce the effects of interference within the member caused by reflections from coherent light incident on a ground plane. The modification described involves formation of an interface layer between a blocking layer and a charge generation layer, the interface layer comprising a polymer having incorporated therein filler particles of synthetic silica or mineral particles. A preferred material is aerosil silica from 10 to 80% by weight. The filler particles scatter the light preventing reflections from the ground plane back to the light incident surface.

U.S. Pat. No. 5,401,600 to Aizawa et al, issued Mar. 28, 1995—An intermediate layer is disclosed having fine hydrophobic silica particles positioned between a substrate and a photosensitive layer. The fine hydrophobic silica particles preferably have a primary particle-averaged size of not more than 50 nm and desirably the surface of the fine hydrophobic silica particles is alkyl-silated or treated with silicone.

U.S. Pat. No. 5,372,904 to Yu et al., issued Dec. 13, 1994—An electrophotographic imaging member is disclosed comprising a substrate having an electrically conductive metal oxide surface, a hole blocking layer and at least one electrophotographic imaging layer, the hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) the metal oxide surface.

U.S. Pat. No. 5,385,796 to Spiewak et al., issued Jan. 31, 1995—An electrophotographic imaging member is disclosed comprising a substrate having an electrically conductive metal oxide surface, a hole blocking layer and at least one electrophotographic imaging layer, the hole blocking layer comprising a reaction product of (a) a material selected from the group consisting of a hydrolyzed organozirconium compound, a hydrolyzed organotitanium compound and mixtures thereof, (b) a hydroxyalkylcellulose, (c) a hydrolyzed organoaminosilane, and (d) the metal oxide surface.

U.S. Pat. No. 4,579,801 to Yashiki, issued Apr. 1, 1986—An electrophotographic imaging member is disclosed characterized by having a phenolic resin layer formed from a resol coat, between a substrate and a photosensitive layer. This phenolic layer may also comprise a dispersion of conductive powders of metals, e.g. nickel, copper, silver, aluminum, and the like; conductive powders of metal oxides, e.g. iron oxide, tin oxide, antimony oxide, indium oxide, titanium oxide, aluminum oxide and the like; and powders of carbon powder, barium carbonate and barium sulfate. Titanium oxide powder may be treated with tin oxide or alumina. Also, a resin layer free of conductive powder may be utilized between the conductive layer and photosensitive layer.

U.S. Pat. No. 4,775,605 to Seki et al., issued Oct. 4, 1988—A repeatedly reusable photosensitive material for electrophotography is disclosed comprising an electroconductive substrate, a photosensitive layer and an intermediate layer located between said electroconductive substrate and said photosensitive layer, characterized in that said intermediate layer comprises a dispersion of an electroconductive polymer and an inorganic white pigment. The white pigment has a refractive index of not less than 1.9, e.g. titanium dioxide, zinc oxide, zinc sulfide, white lead, lithopone and the like.

U.S. Pat. No. 4,837,120 to Akiyoshi et al., issued Jun. 6, 1989—An improved electrophotographic photoconductor is disclosed comprising a cylindrical electroconductive support and a photoconductive layer formed on the electroconductive support, which electroconductive support comprises a base support made of a phenol resin with a releasing rate of ammonia therefrom per 48 hours being 50 ppm or less. An undercoat layer may be interposed between the electroconductive support and photoconductive layer. Such undercoat layer may comprise (i) a resin layer of polyamide (such as Nylon 66 or Nylon 610, copolymer of nylon), polyurethane, or polyvinyl alcohol and (ii) an electroconductive resin layer comprising any of the above resins and finely-divided inorganic particles of titanium oxide, zinc oxide and magnesium oxide.

U.S. Pat. No. 4,871,635 to Seki et al., issued Oct. 3, 1989—A repeatedly usable electrophotographic photoconductor is disclosed comprising (a) and electroconductive support, (b) an undercoat layer containing therein at least one salt selected from the group consisting of carboxylates, amino carboxylates, phosphates, polyphosphates, phosphites, phosphite derivatives, borates, sulfates and sulfites and (c) a photoconductive layer, which layers are successively overlaid on the electroconductive support. The undercoat layer may also contain a binder resin such as polyvinyl alcohol, casein, sodium polyacrylate, nylon, a polyurethane, a melamine resin, or an epoxy resin.

U.S. Pat. No. 4,822,705 to Fukagai et al., issued Apr. 18, 1989—An electrophotographic photoconductor is disclosed comprising an electroconductive support, an intermediate layer formed thereon, an a photoconductive layer formed on said intermediate layer, which intermediate layer comprises at least one component selected from the group consisting of: (a) monohydric aliphatic alcohol, (b) dihydric aliphatic alcohol, (c) polyethylene glycol, (d) polypropylene glycol, (e) polybutylene glycol, (f) polyethylene glycol monoester and/or polyethylene glycol diester, (g) polyethylene monoether, (h) crown ether, (i) a random or block copolymer having as structure units a hydroxyethylene group and a hydroxypropylene group, and hydroxyl groups at the terminal thereof, and (j) a polymer of a monomer having formula (I) and a copolymer of said monomer and a counterpart monomer having a specified structural formula. The intermediate layer also contain electroconductive powders suc as tin oxide, antimony oxide, and/or white pigments such as zinc oxide, zinc sulfide, and titanium oxide.

U.S. Pat. No. 4,906,545 to Fukagai et al., issued Mar. 6, 1990—An electrophotographic photoconductor is disclosed, which comprises an electroconductive support, an undercoat layer formed on the electroconductive support, comprising at least one metal oxide selected from the group consisting of zirconium oxide, magnesium oxide, calcium oxide, beryllium oxide and lanthanum oxide, and a photoconductive layer comprising a charge generating layer and a charge transporting layer, formed on the undercoat layer. The oxides may be employed with various thermoplastic or thermosetting binder resins.

U.S. Pat. No. 5,139,907 to Y. Simpson et al., issued Aug. 18, 1992—A layered photosensitive imaging member is described which is modified by forming a low-reflection layer on the ground plane. The low-reflection layer serves to reduce an interference contrast and according to a second aspect of the invention, layer adhesion is greatly improved when selecting $TiO_2$ as the low-reflection material. In a preferred embodiment, low-reflection materials having an index of refraction greater than 2.05 were found to be most effective in suppressing the interference fringe contrast.

U.S. Pat. No. 5,051,328 to J. Andrews et al., issued Sep. 24, 1991—A layered photosensitive imaging member is disclosed which has been modified to reduce the effects of interference within the member caused by reflections from coherent light incident on a base ground plane. The modification described is to form the ground plane of a low-reflecting material such as tin oxide or indium tin oxide. An additional feature is to add absorbing materials to the dielectric material upon which the ground plane is formed to absorb secondary reflections from the anti-curl back coating layer air interface. The absorbing material can be a dye such as Sudan Blue 670.

U.S. Pat. No. 4,618,552 to S. Tanaka et al., issued Oct. 21, 1986—A light receiving member is disclosed comprising an intermediate layer between a substrate of a metal of an alloy having a reflective surface on a photosensitive member, the reflective surface of the substrate forming a light-diffusing reflective surface, and the surface of the intermediate layer forming a rough surface. A light receiving member comprising a subbing layer having a light diffusing reflective surface with an average surface roughness of half or more of the wavelength of the light source for image exposure is provided between an electroconductive surface and a photosensitive layer. A light absorber may also be contained in the electroconductive layer.

U.S. Pat. No. 5,096,792 to Y. Simpson et al, issued Mar. 17, 1992—A layered photosensitive imaging member is disclosed which is modified to reduce the effects of interference within the member caused by reflections from coherent light incident on a base ground plane. The modification involves a ground plane surface with a rough surface morphology by various selective deposition methods. Light reflected from the ground plane formed with the rough surface morphology is diffused through the bulk of the photosensitive layer breaking up the interference fringe patterns which are later manifested as a plywood pattern on output prints made from the exposed sensitive medium.

European Patent Application No. 0 462 439 A1, published Dec. 27, 1991—A layered photosensitive medium is modified to reduce the effects of destructive interference within the medium caused by reflection from coherent light incident thereon. The modification is to roughen the surface of the substrate upon which the ground plane is formed, the ground plane formed so as to conform to the underlying surface roughness. Light reflected from the ground plane is diffused through the bulk of the photosensitive layer breaking up the interference fringe patterns which are later manifested as a plywood defect on output prints made from the exposed photosensitive medium.

U.S. patent application Ser. No. D/92282, filed Mar. 9, 1994, Ser. No. 209,894 now U.S. Pat. No. 5,460,911—An electrophotographic imaging member is disclosed comprising a substrate, a hole blocking, an optional interface adhesive layer, a charge generating layer, and a charge transport layer, the hole blocking layer comprising a light absorbing material selected from the group consisting of a dye, pigment, or mixture thereof dissolved or dispersed in a hole blocking matrix comprising a film forming polymer, the light absorbing material being capable of absorbing incident radiation having a wavelength between about 550 and about 950 nm. The dye or pigment may have a violet, blue, green, cyan or black color to absorb incident radiation having a wavelength between about 550 and about 950 nm. These imaging members may be utilized in an electrophotographic imaging process.

CROSS REFERENCE TO RELATED APPLICATIONS

This application is related to the following U.S. patent applications:

U.S. patent application Ser. No. 08/583,904 now U.S. Pat. No. 5,612,157, filed concurrently herewith by James M. Markovics et al. and entitled "CHARGE BLOCKING LAYER FOR ELECTROPHOTOGRAPHIC IMAGING MEMBER"—An electrophotographic imaging member is disclosed including a substrate, a hole blocking layer comprising hydrolyzed metal alkoxide or aryloxide molecules and a film forming alcohol soluble nylon polymer, an optional interface adhesive layer, a charge generating layer, and a charge transport layer.

U.S. patent application Ser. No. 08/587,114 allowed, filed concurrently herewith by James M. Markovics et al. and entitled "ELECTROPHOTOGRAPHIC IMAGING MEMBER WITH IMPROVED CHARGE BLOCKING LAYER"—An electrophotographic imaging member is disclosed including a substrate, a hole blocking layer, an optional interface adhesive layer, a charge generating layer, and a charge transport layer, the blocking layer comprising solid finely divided organic electron transporting pigment particles having a short hole range, dispersed in a film forming polymer matrix.

U.S. patent application Ser. No. 209,894, filed Mar. 14, 1994, by Robert C. U. Yu et al., entitles et al., entitled ELECTROPHOTOGRAPHIC IMAGING MEMBER FREE OF REFLECTION INTERFERENCE—An electrophotographic imaging member is disclosed comprising a substrate, a hole blocking, an optional interface adhesive layer, a charge generating layer, and a charge transport layer, the hole blocking layer comprising a light absorbing material selected from the group consisting of a dye, pigment, or mixture thereof dissolved or dispersed in a hole blocking matrix comprising a film forming polymer, the light absorbing material being capable of absorbing incident radiation having a wavelength between about 550 and about 950 nm. The dye or pigment may have a violet, blue, green, cyan or black color to absorb incident radiation having a wavelength between about 550 and about 950 nm. These imaging members may be utilized in an electrophotographic imaging process.

While the above mentioned electrophotographic imaging members may be suitable for their intended purposes, there continues to be a need for improved imaging members, particularly for material modified multilayered electrophotographic imaging members in both flexible belt and rigid drum configurations.

SUMMARY OF THE INVENTION

It is therefore an object of the present invention to provide improved layered electrophotographic imaging members which overcome the above noted shortcomings.

It is also an object of the present invention to provide an improved layered electrophotographic imaging member having a modified charge blocking layer that is free of the formation of siloxane aggregates.

It is yet an object of the present invention to provide an improved layered electrophotographic imaging member having a modified charge blocking layer that has a uniform thickness and possesses both charge blocking and anti reflection characteristics.

It is a further object of the present invention to provide improved layered electrophotographic imaging members which include a single layer performing both charge blocking and reflection interference fringe elimination functions.

It is yet another object of the present invention to provide improved layered electrophotographic imaging members which include an anti reflection charge blocking layer.

It is also another object the present invention to provide improved positive charging electrophotographic imaging members which include an anti reflection surface layer.

It is yet a further object of the present invention to provide an improved electrophotographic imaging member having a charge blocking layer which exhibits greater adhesion to the adjacent layers.

It is still a further object of the present invention to provide improved layered electrophotographic imaging members for use with liquid or dry developers.

It is still a further object of the present invention to provide an improved electrophotographic imaging member having a charge blocking layer which suppresses the development of charge deficient spots associated with copy printout defects.

It is still yet another further object of the present invention to provide an electrophotographic imaging member which is free of cracks in the charge blocking layer.

It is another further object of the present invention to provide improved layered electrophotographic imaging members that exhibit high quality imaging and printing characteristics.

These and other objects of the present invention are accomplished by providing an electrophotographic imaging member comprising a substrate, a charge blocking layer, an optional adhesive interface layer, a charge generating layer, and a charge transport layer, the charge blocking layer comprising solid finely divided light scattering inorganic particles having an average particle size between about 0.3 micrometer and about 0.7 micrometer selected from the group consisting of amorphous silica, mineral particles and mixtures thereof, dispersed in a matrix material comprising the chemical reaction product of (a) a charge blocking film-forming polymer selected from the group consisting of hydroxyalkylcellulose, hydroxy alkyl methacrylate polymer, hydroxy alkyl methacrylate copolymer and mixtures thereof and (b) an organosilane.

A substantial refractive index mismatch between the dispersed particles and the matrix material is desirable. This mismatch is achieved by selection of dispersed particles which function as discrete light scattering centers to effectively remove any light reflection component of light incident surface at the top of the imaging member thereby eliminating the interference fringes or the cause of plywood defects. Without the substantial refractive index mismatch between the dispersed particles and the matrix material, the reflection component is normally reflected back from the electrically conductive surface of the substrate. The presence of a chemical reaction product at the surface of the dispersed particles in the charge blocking layer of the present invention can also substantially enhance the adhesive strength.

Electrophotographic imaging members free of any separate and distinct adhesive layer in contiguous contact with the charge blocking layer are particularly preferred for drum configuration applications. Similarly, electrophotographic imaging members containing an organometallic chelate compound selected from the group consisting of an organotitanium chelate compound, an organozirconium chelate compound, and an organoaluminum chelate compound in the charge blocking layer are preferred for drum configuration applications. These imaging members may be utilized in any suitable electrophotographic imaging process.

BRIEF DESCRIPTION OF THE DRAWINGS

A more complete understanding of the imaging device of the present invention purpose can be obtained by reference to the accompanying drawings wherein.

These figures are merely the schematic representations of the present invention and are not intended to indicate relative size and dimensions of electrophotographic imaging members or imaging apparatus or components thereof.

DETAILED DESCRIPTION OF THE DRAWINGS

For the sake of convenience, the invention though will be described for electrophotographic imaging members only in the flexible belt configuration. However, it is to be understood that the present invention includes electrophotographic imaging members having other configurations including, for example, a rigid drum configuration.

Figure 1:
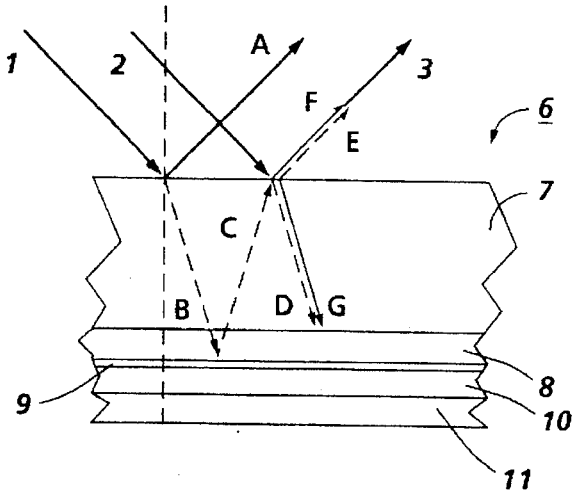
FIG. 1 PRIOR ART
FIG. 1 is a schematic representation showing coherent light incident upon a prior art layered photosensitive medium leading to reflections internal to the medium.

Referring to FIG. 1, a coherent beam is shown incident on a layered electrophotographic imaging member 6 comprising a charge transport layer 7, charge generator layer 8, a conductive ground plane 9, a support substrate 10, and an anti-curl back coating 11. The interference effects which occur can be explained by following two typical rays of the incident illumination. The two dominant reflections of a typical ray 1, are from the top surface of layer 7, ray A, and from the top surface of ground plane 9, ray C. The transmitted portion of ray C, ray E, combines with the reflected portion of ray 2, ray F, to form ray 3. Depending on the optical path difference as determined by the thickness and index of refraction of layer 7, the interference of rays F and E can be constructive or destructive when they combine to form ray 3. The transmitted portion of ray 2, ray G, combines with the reflected portion of ray C, ray D, and the interference of these two rays determines the light energy delivered to the generator layer 8. When the thickness is such that rays E and F undergo constructive interference, more light is reflected from the surface than average, and there will be destructive interference between rays D and G, delivering less light to generator layer 8 than the average illumination. When the transport layer 7 thickness is such that reflection is a minimum, the transmission into layer 8 will be a maximum. The thickness of practical transport layers varies by several wavelengths of light so that all possible interference conditions exist within a square inch of surface. This spatial variation in transmission of the top transparent layer 7 is equivalent to a spatial exposure variation of generator layer 8. This spatial exposure variation present in the image formed on the electrophotographic imaging member becomes manifest in the output copy derived from the exposed electrophotographic imaging member. The output copy exhibits a pattern of light and dark interference fringes which look like the grains on a sheet of plywood, hence the term "plywood effect" is generically applied to this problem. In the event that the ground plane 9 used for fabricating the imaging member is an optically transparent layer, the internal reflection that causes the interference fringes resulting in plywood formation will no longer be coming from the top surface of the ground plane, but rather from the bottom surface of anti-curl back coating 11 below, due to the refractive index mismatch between the anti-curl back coating (e.g. having a refractive index of 1.56) and the air (e.g. having a refractive index of 1.0) as the internal ray B passes through the optically clear substrate support 10 and the optically clear anti-curl back coating 11 before exiting to the air.

Figure 2:
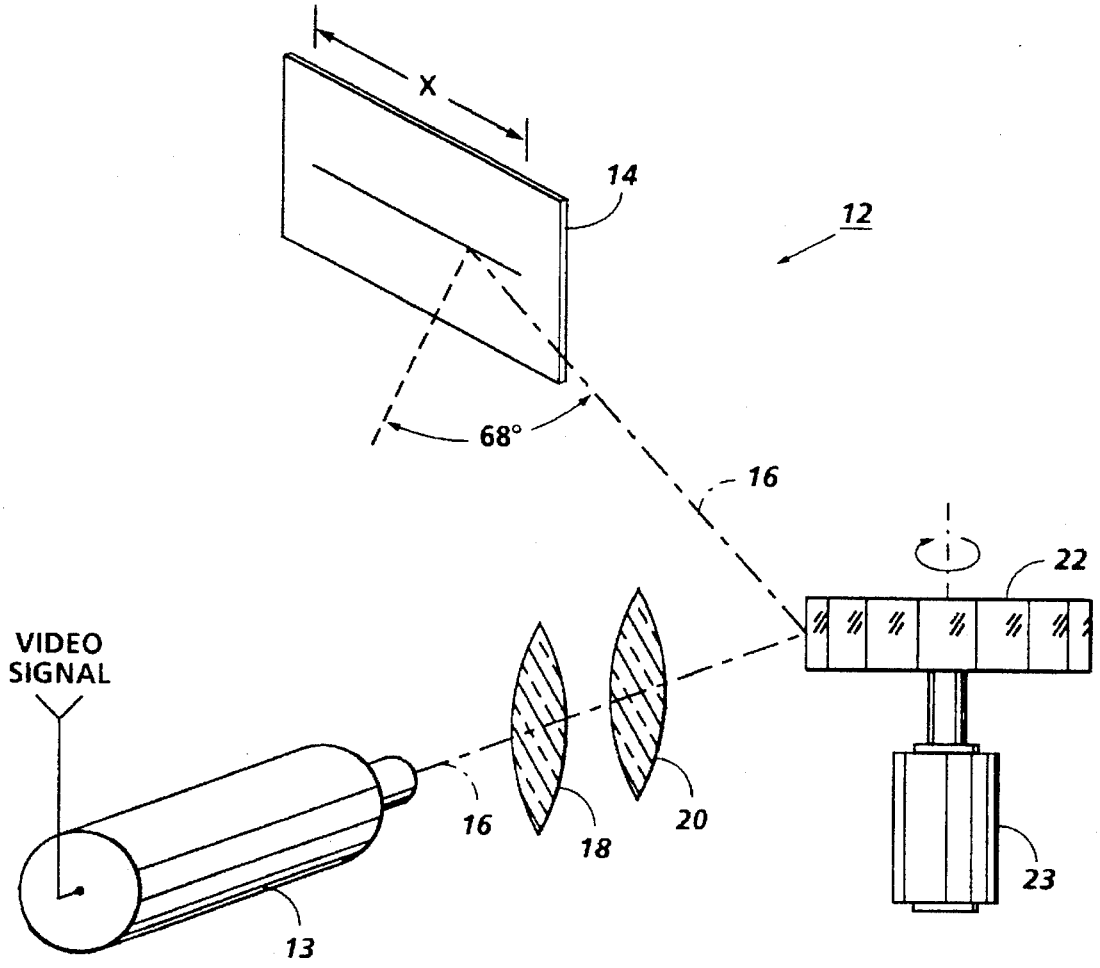
FIG. 2 is a schematic representation of an optical system incorporating a coherent light source to scan a light beam across an electrophotographic imaging member.

FIG. 2 shows an imaging system 12 wherein a laser 13 produces a coherent output which is scanned across an electrophotographic imaging member 14. Laser 13 is, for this illustrated embodiment, a helium neon laser with a characteristic wavelength of 0.633 micrometer. However, it may instead be, for example, an Al Ga As Laser diode with a characteristic wavelength of 0.78 micrometer. In response to video signal information representing information to be printed or copied, laser 13 is driven to provide a modulated light output beam 16. The laser output, whether gas or laser diode, comprises light which is polarized parallel to the plane of incidence. Flat field collector and objective lens 18 and 20, respectively, are positioned in the optical path between laser 13 and light beam reflecting scanning device 22. In a preferred embodiment, device 22 is a multifaceted mirror polygon driven by motor 23, as shown. Flat field collector lens 18 collimates the diverging light beam 16 and field objective lens 20 causes the collected beam to be focused onto an electrophotographic imaging member 14, after reflection from polygon 22. If electrophotographic imaging member 14 is a layered prior art photoreceptor having the structure shown in FIG. 4, it can encounter plywood interference fringe problems. If electrophotographic imaging member 14 is modified in accordance with the present invention to achieve the layered photoreceptor structures 15 and 16 shown in FIGS. 5 and 6, respectively, the plywood interference fringe problem can be eliminated.

Figure 3:
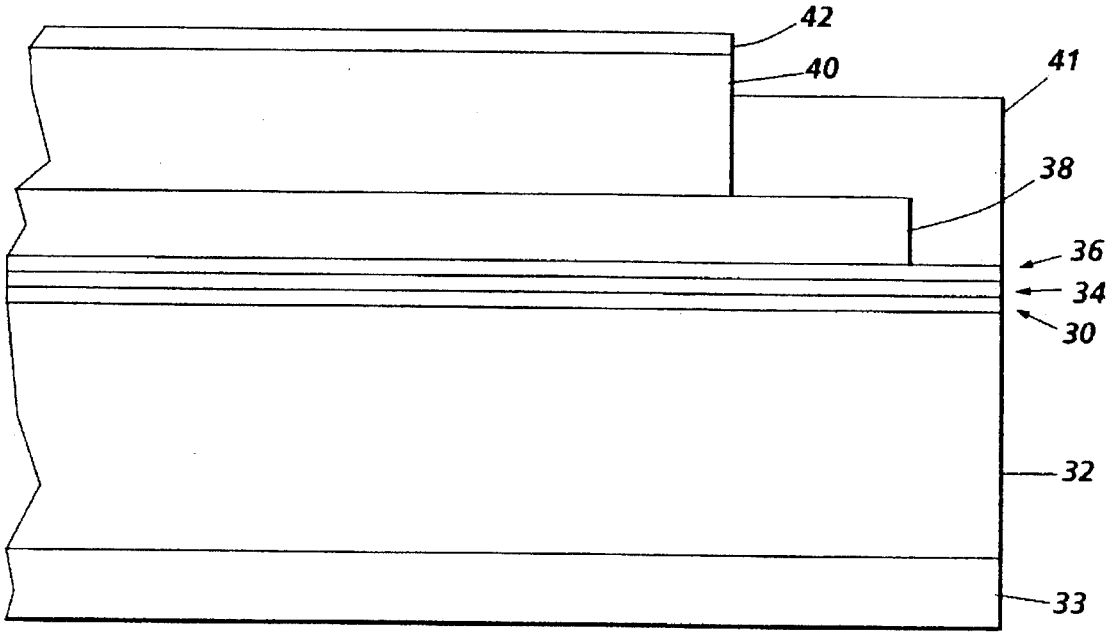
FIG. 3 is a complete schematic cross-sectional view of a typical prior art electrophotographic imaging member as that is described in FIG. 1.

In a typical prior art electrophotographic imaging member shown in FIG. 3, the thickness of the substrate layer 32 depends on numerous factors, including mechanical strength and economical considerations, and thus, this layer for a flexible belt may, for example, have a thickness of at least about 50 micrometers, or of maximum thickness of less than about 150 micrometers, provided there are no adverse effects on the final electrophotographic imaging device. For drum type imaging member applications, the substrate is normally a rigid cylinder. The conductive layer 30 may vary in thickness over substantially wide ranges depending on the optical transparency and flexibility desired for the electrophotographic imaging member. Accordingly, when a flexible electrophotographic imaging belt is desired, the thickness of the conductive layer may be between about 20 angstrom units and about 750 angstrom units, and more preferably between about 50 Angstrom units and about 200 angstrom units for an optimum combination of electrical conductivity, flexibility and light transmission. The conductive 30 layer may be an electrically conductive metal layer which may be formed, for example, on the substrate by any suitable coating technique, such as a vacuum depositing or sputtering technique. Typical metals include aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted. Upon exposure to the ambient atmospheric environment, the electrically conductive metal ground plane reacts with the atmosperic oxygen and spontaneously forms a thin metal oxide layer on its surface.

After formation of an electrically conductive surface, a hole blocking layer 34 may be applied thereto for photoreceptors employing negative surface charging. However, an electron blocking layer is generally used for a positively charged photoreceptor to allow migration of holes from the imaging layer surface of the photoreceptor through the electron blocking layer toward the conductive layer during electrophotographic imaging processes. Various charge blocking layers capable of forming an electronic barrier to charges between the adjacent photoconductive layer and the underlying conductive layer are utilized in the prior art. The charge blocking layer may comprise nitrogen containing organosilanes, nitrogen containing organotitanium or organozirconium compounds, or a mixture of these materials, as disclosed for example, in U.S. Pat. Nos. 4,291,110, 4,338,387, 4,286,033 and 4,291,110, the disclosures of these patents being incorporated herein in their entirety.

An optional adhesive layer 36 may be applied to the charge blocking layer of the prior art. Any suitable adhesive layer may be utilized. One well known adhesive layer comprises a polyester resin available as MOR-ESTER 49,000 from Morton International Inc.. The MOR-ESTER 49,000 is a linear saturated copolyester reaction product of four diacids and ethylene glycol. The MOR-ESTER 49,000 linear saturated copolyester consists of alternating monomer units of ethylene glycol and four randomly sequenced diacids in the above indicated ratio and has a weight average molecular weight of about 70,000. Another example of an adhesive layer comprises a copolyester resin such as, for example, Vitel PE-100, Vitel PE-200, Vitel PE-200D, and Vitel PE-222, all available from Goodyear Tire and Rubber Co. Any adhesive layer employed should be continuous and preferably has a dry thickness between about 200 micrometers and about 900 micrometers and, more preferably, between about 400 micrometers and about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture of this invention to the charge blocking layer.

Any suitable photogenerating layer 38 may be applied to the blocking layer 34 or adhesive layer 36, if an adhesive layer is employed. The photogenerating layer may thereafter be overcoated with a contiguous charge transport layer 40. Examples of photogenerating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine described in U.S. Pat. No. 3,357,989, metal phthalocyanines such as vanadyl phthalocyanine and copper phthalocyanine, quinacridones available from E. I. dupont de Nemours & Co. under the tradename Monastral Red, Monastral violet and Monastral Red Y, Vat Orange 1 and Vat Orange 3 trade names for dibromo anthanthrone pigments, benzimidazole perylene, substituted 2,4-diaminotriazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure thereof being incorporated herein by reference. Multi-photogenerating layer compositions may be utilized where a photoconductive layer enhances or reduces the properties of the photogenerating layer. Examples of this type of configuration are described in U.S. Pat. No. 4,415,639, the entire disclosure of thereof being incorporated herein by reference. Other suitable photogenerating materials known in the art may also be utilized, if desired. Any suitable charge generating binder layer comprising photoconductive particles dispersed in a film forming binder may be utilized. Photoconductive particles for charge generating binder layer such vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially sensitive to white light. Vanadyl phthalocyanine, metal free phthalocyanine and tellurium alloys are preferred because these materials provide the additional benefit of being sensitive to infrared light. The photogenerating materials selected should be sensitive to activating radiation having a wavelength between about about 600 and about 800 nm during the imagewise radiation exposure step in a electrophotographic imaging process to form an electrostatic latent image.

Any suitable inactive resin materials may be employed in the photogenerating binder layer including those described, for example, in U.S. Pat. No. 3,121,006, the entire disclosure thereof being incorporated herein by reference. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like. These polymers may be block, random or alternating copolymers.

The photogenerating composition or pigment can be present in the resinous binder composition in various amounts. Generally, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition.

The photogenerating layer containing photoconductive compositions and/or pigments and the resinous binder material generally has a thickness of between about 0.1 micrometer and about 5 micrometers, and preferably has a thickness of between about 0.3 micrometer and about 3 micrometers. The photogenerating layer thickness is related to binder content. Higher binder content compositions generally require thicker layers for photogeneration. Thicknesses outside these ranges can be selected providing the objectives of the present invention are achieved.

The active charge transport layer 40 may comprise any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer 40 not only serves to transport holes or electrons, but also protects the photoconductive layer 38 from abrasion or chemical attack and therefor extends the operating life of the photoreceptor imaging member. The charge transport layer 40 should exhibit negligible, if any, discharge when exposed to a wavelength of light useful in xerography, e.g. about 4000 angstroms to about 9000 angstroms. Therefore, the charge transport layer is substantially transparent to radiation in a region in which the photoconductor is to be used. Thus, the active charge transport layer is a substantially non-photoconductive material which supports the injection of photogenerated holes or electrons from the charge generation layer. The active transport layer is normally transparent when exposure is effected through the active layer to ensure that most of the incident radiation is utilized by the underlying charge carrier generator layer for efficient photogeneration. The charge transport layer in conjunction with the generation layer in the instant invention is a material which is an insulator to the extent that an electrostatic charge placed on the transport layer is not conducted in the absence of activating illumination.

The active charge transport layer 40 may comprise any suitable activating compound useful as an additive dispersed in electrically inactive polymeric materials making these materials electrically active. These compounds may be added to polymeric materials which are incapable of supporting the injection of photogenerated holes or electrons from the generation material and incapable of allowing the transport of these holes or electrons therethrough. This will convert the electrically inactive polymeric material to a material capable of supporting the injection of photogenerated holes or electrons from the generation material and capable of allowing the transport of these holes or electrons through the active layer in order to discharge the surface charge on the active layer.

The charge transport layer forming mixture preferably comprises an aromatic amine compound. An especially preferred charge transport layer employed in one of the two electrically operative layers in the multilayer photoconductor of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free from electron withdrawing groups such as $NO_2$ groups, CN groups, and the like. Typical aromatic amine compounds include, for example, triphenylmethane, bis(4-diethylamine-2-methylphenyl)phenylmethane; 4,4'-bis(diethylamino)-2,2'-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like dispersed in an inactive resin binder.

Any suitable inactive resin binder soluble in methylene chloride, chlorobenzene or other suitable solvent may be employed in the process of this invention. Typical inactive resin binders include polycarbonate resin, polyvinylcarbazole, polyester, polyarylate, polyacrylate, polyether, polysulfone, and the like.

Examples of photosensitive members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety.

Any suitable and conventional techniques may be utilized to mix and thereafter apply the charge transport layer coating mixture to the charge generating layer. Typical application techniques include extruding spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers and about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to about 200:1 and, in some instances, as great as 400:1.

Other layers such as conventional ground strip layer 41 comprising, for example, conductive particles dispersed in a film forming binder may be applied to one edge of the photoreceptor in contact with the conductive layer 30, charge blocking layer 34, adhesive layer 36 or charge generating layer 38. The ground strip layer 41 may have a thickness from about 7 micrometers to about 42 micrometers, and preferably from about 14 micrometers to about 23 micrometers.

Optionally, an overcoat layer 42 may also be utilized to improve resistance to abrasion. In some flexible electrophotographic imaging members, an anti-curl back coating 33 may be applied to the side opposite the side bearing the electrically active coating layers in order to provide flatness and/or abrasion resistance. These overcoating and anti-curl back coating layers may comprise organic polymers or inorganic polymers that are electrically insulating or slightly semi-conductive. In embodiments using rigid drum imaging devices, an anti-curl coating is not employed.

The electrophotographic imaging member of the present invention may be employed in any suitable and conventional electrophotographic imaging process which utilizes uniform charging prior to imagewise exposure to activating electromagnetic radiation.

Figure 4:
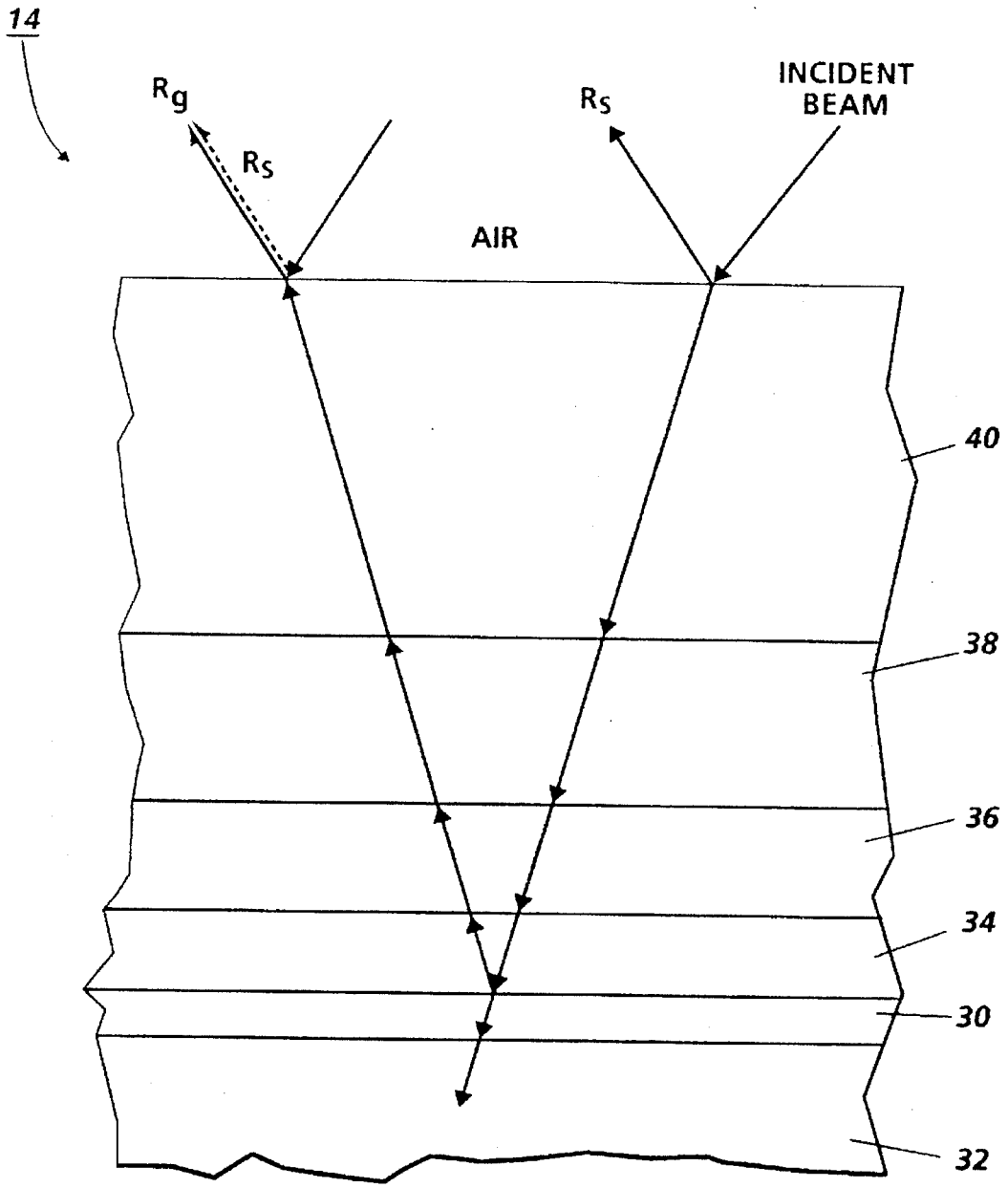
FIG. 4 is a partial schematic cross-sectional view of the electrophotographic imaging member of FIG. 3 with conventional coating layers to illustrate a plywood effect.

Referring to FIG. 4, light beam (e.g. 633 nm wavelength) interaction with a specific electrophotographic imaging member, similar to the prior art imaging member configuration of FIG. 3, is schematically illustrated. The electrophotographic imaging member 14 is a flexible layered photoreceptor which includes, for purposes of illustration, an electrically conductive titanium ground plane layer 30 formed on a polyethylene terephthalate dielectric supporting substrate 32. Conductive layer 30 is coated, for example, with an organopolysiloxane blocking layer 34 which functions as a hole blocking layer. Formed on top of blocking layer 34 is an interface layer 36, e.g. polyester adhesive, which is coated with a charge generation layer 38. A charge transport layer 40 overlies charge generation layer 38.

As shown in FIG. 4, one incident beam of light is partially reflected as beam $R_s$. The remainder of the incident beam of light enters the charge transport layer 40 and is bent, due to the refractive index difference between air (having a value of 1.0) and layer 40 (having a value of 1.57). Since the refractive indexes of all the internal layers 34, 36, 38 and 40 are about the same, no significant internal refraction is normally encountered and the light, therefore, travels in a straight line through these layers. Although the residual light energy (after large photon absorption by layer 38) that eventually reaches the thin conductive layer 30 is partially transmitted through conductive layer 30, nevertheless, a greater fraction is reflected back to layer 40 and exits to the air as beam $R_g$. The emergence of the light energy $R_g$ from the photoreceptor 14 directly interferes with the reflected light $R_s$, resulting in the formation of an observed plywood fringes effect.

Figure 5:
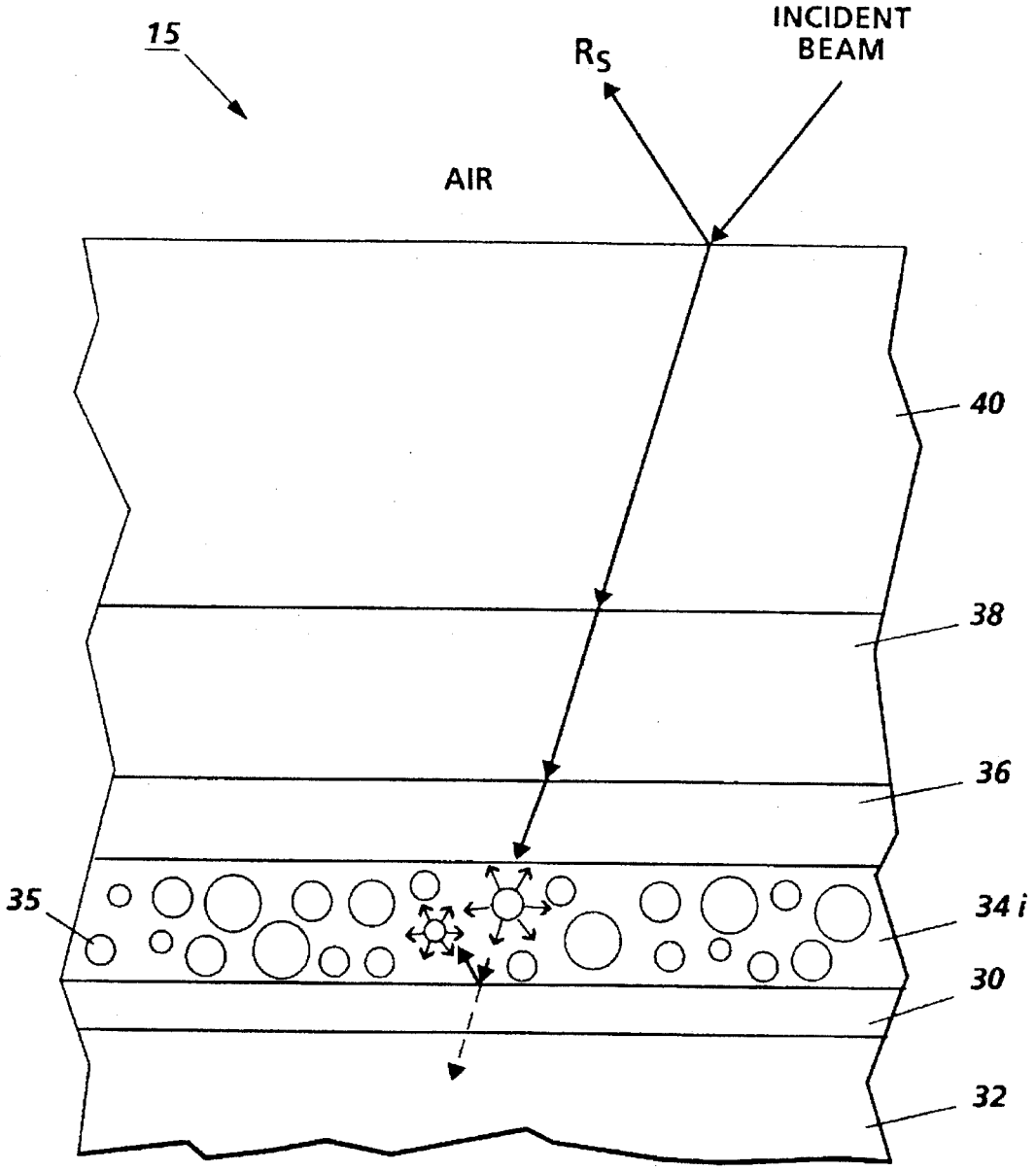
FIG. 5 is a partial schematic cross-sectional view of the electrophotographic imaging member similar to that shown in FIG. 4 wherein the conventional charge blocking layer is replaced by a coherent light scattering charge blocking layer of this invention.

The present invention overcomes the shortcomings of the prior art by providing an imaging member with an improved hole blocking layer **34*i* shown in FIG. 5. Hole blocking layer 34*i* is a modification of the organopolysiloxane blocking layer 34 shown in FIG. 4 and is achieved by dispersing ultrafine inorganic particles 35 in a specific hole blocking matrix material to achieve a refractive index mismatch which produces sufficient scattering of the radiation which reaches the blocking layer 34*i* so that substantially no radiation is reflected back from the conductive ground plane into the overlying layers. The highly effective light scattering effect achieved with the blocking layer of this invention eliminates the formation of reflection interference fringes. To more specifically illustrate elimination of interference fringes formation, the organoaminosilane hole blocking layer 34 of the electrophotographic imaging member 14 of FIG. 4 is modified, in accordance with one embodiment of this invention described in Example IV, to form a 1.0 micrometer thick layer comprising the chemical reaction product of gamma aminopropyltriethoxy silane, poly (2-hydroxyethyl methacrylate), and a dispersion of ultrafine amorphous silica particles 35. The resulting electrophotographic imaging member 15, shown in FIG. 5, not only achieves substantially effective light scattering as the transmitted light enters the invention hole blocking layer 34*i*, it also provides additional back scattering capability for total removal of any residual light energy which would normally be reflected back from the conductive ground plane 30 thereby eliminating the beam $R_g$, shown in FIG. 4**, and resolving the plywooding interference fringes problem.

The hole blocking layer of this invention is applied to the electrically conductive surface of the electrically conductive layer 30 or directly over an electrically conductive substrate. The applied hole blocking layer, after drying, comprises solid finely divided light scattering inorganic particles having an average particle size between about 0.3 micrometer and about 0.7 micrometer selected from the group consisting of amorphous silica, mineral particles and mixtures thereof, dispersed in a matrix material comprising the chemical reaction product of (a) a charge blocking film-forming polymer selected from the group consisting of hydroxyalkylcellulose, hydroxy alkyl methacrylate polymer, hydroxy alkyl methacrylate copolymer and mixtures thereof and (b) an organosilane.

The charge blocking layer matrix material may optionally include a titanium, zirconium or aluminum chelate compound or mixture of these chelate compounds.

Figure 6:
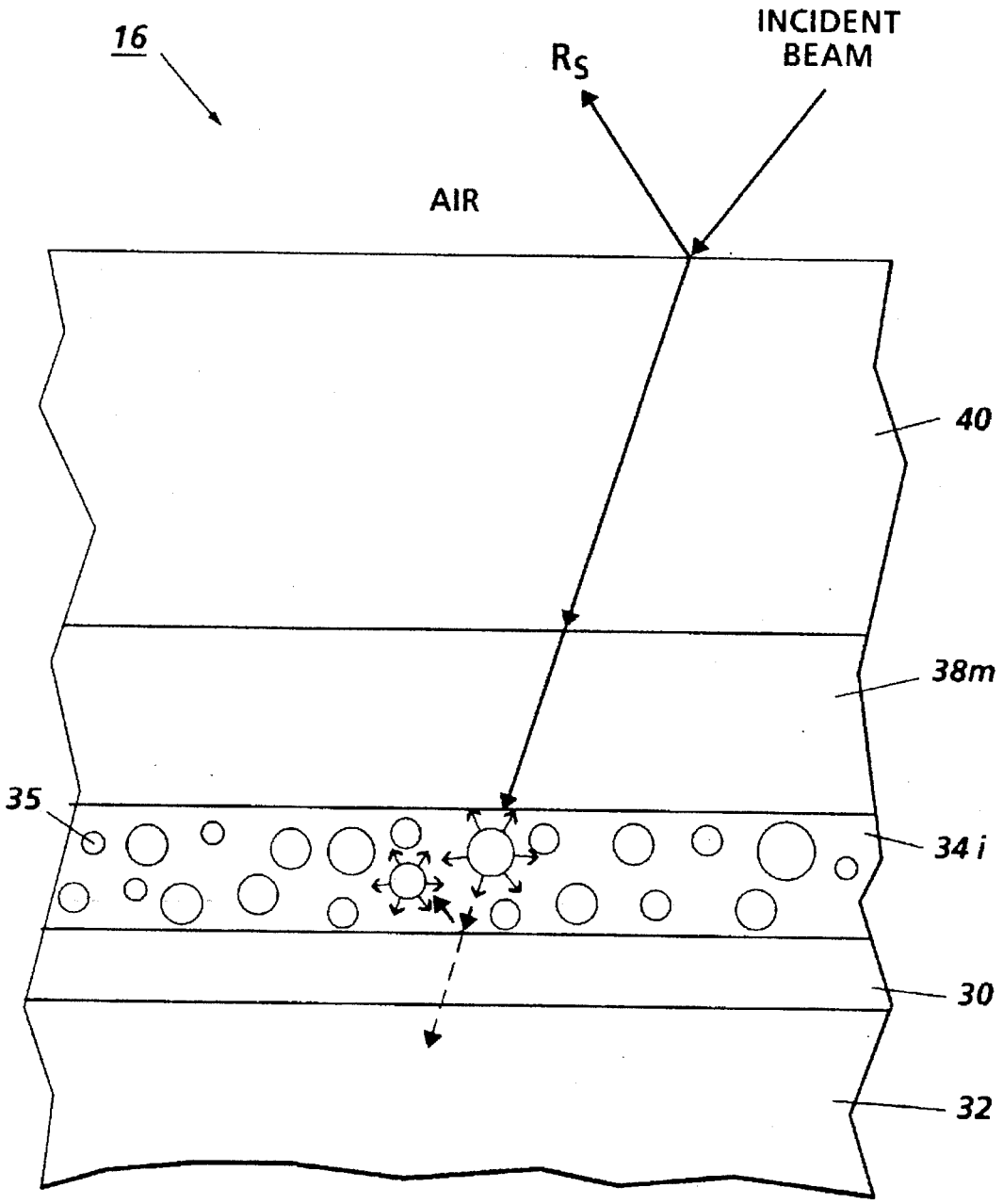
FIG. 6 is a partial schematic cross-sectional view of the electrophotographic imaging member similar to that shown in FIG. 4 wherein a coherent light scattering charge blocking layer of the present invention is used without a separate interface adhesive layer.

In FIG. 6, a structurally simplified electrophotographic imaging member 16, shown containing a hole blocking layer formulation of this invention but with the omission of the interface adhesive layer from the imaging member 15 of FIG. 5, is illustrated. In this electrophotographic imaging member embodiment, the hole blocking layer **34*i*, described above with reference to FIG. 5, is applied directly over a modified charge generating layer 38*m*. Since the imaging member illustrated in FIG. 6 does not contain the interface adhesive layer 36 shown in FIG. 5, a modified charge generating layer 38*m* containing an adhesive promotion material may be utilized to improve adhesion for seamed flexible belts, which otherwise would have a tendency to delaminate, but need not be employed in rigid imaging member drum designs. The modified charge generating layer 38*m* may typically contain up to about 10 percent by weight of of a suitable adhesion promotor such as MOR-ESTER 49,000 polyester. The electrophotographic imaging member 16 shown in FIG. 6 can suppress plywood fringes formation through the same light scattering mechanism described in FIG. 5**.

Any suitable finely divided light scatttering inorganic particles selected from the group consisting of amorphous silica and mineral particles may be utilized in the charge blocking layer of this invention. Typical mineral particles include, for example, oxides, silicates, carbonates, sulfates, sulfites, iodites, hydroxides, chlorides, flourites, phosphates, chromates, chromites, clay, sulfur, and the like. The expression "mineral", as employed herein, is defined as the inorganic constituents of the earth's crust including naturally ocurring elements, compounds and mixtures having a definite range of chemical composition and properties or the synthesized versions thereof. The mineral particles may have chemically reactive groups capable of reacting with reactive groups on the film forming polymer and organosilane. Typical chemically reactive groups on the mineral particles include, for example, hydroxides, oxides, silanols and the like.

The particles selected for dispersion in a hole blocking matrix should have the capability of substantially scattering all the incident radiation, having a wavelength between about 550 and about 950 nm, in order to eliminate the interference fringes. In other words, specific light scattering particles or mixtures thereof selected for any given hole blocking layer dispersion should be able to suppress or eliminate substantially all of the activating radiation frequencies to which the charge generator layer employed is exposed.

The solid light scattering particles dispersed in the hole blocking layer matrix should have an average particle size substantially smaller than the thickness of the dried invention blocking layer to avoid particle protrusion. Preferably, the solid light scattering inorganic particles have an average particle size between about 0.3 micrometer and about 0.7 micrometer (about the wavelength of the irradiating light beam) for greater light scattering effectiveness.

The light scattering particles should also have a refractive index significantly different from that of the hole blocking layer matrix material which typically has a refractive index ranging from about 1.54 to about 1.60. A refractive index difference of between about 0.08 and about 1.5 is required to effect satisfactory light scattering results. Preferably, the refractive index difference should be between about 0.1 and about 1.0. Optimum results are achieved with a refractive index difference between about 0.15 to about 0.8 for maximum ease of particle dispersion. The selection of light scattering particles having a refractive index significantly different from the refractive index of the hole blocking layer material matrix is crucially important to the achieving of adequate light scattering and the elimination of plywood fringes. Typical light scattering particles, having a refractive index significanty different from the typical 1.58 refractive index value of the hole blocking layer material matrix, include, for example, synthetic amorphous silica such as fumed silica, precipitated silica, and silica gels. Other mineral particles of equal interest may also include, aluminum oxide (Corundum), antimony oxide (Senarmontite, Valentinite), arsenic oxide (Arsenolite, Claudetite), iron oxide (Hematite, Magnetite), lead oxide (Litharge, Minium), magnesium oxide (Periclas), manganese oxide (Hausmannite, Manganosite, Pyrolusite), nickel oxide (Bunsenite), tin oxide (Cassiterite), titanium oxide (Brookite), zinc oxide (Zincite), zirconium oxide (Baddeleyite), barium sulfate (Barite), lead sulfate (Anglesite), potassium sulfate (Arcanite), sodium sulfate (Thernadite), antimony sulfite (Stibnite), arsenic sulfide (Orpiment, Realgar), cadmium sulfide (Greenockite), calcium sulfide (Oldhamite), iron sulfide (Mrcasite, Pyrite, Pyrrhotite), lead sulfide (Galena), zinc sulfide (Sphalerite, Wurtzite), barium carbonate (Witherite), iron carbonate (Siderite), lead carbonate (Cerussite), magnesium carbonate (Magnesite), manganese carbonate (Rhodochrosite), sodium carbonate (Thermonatrite), zinc carbonate (Smithsonite), aluminum hydroxide (Boehmite, Diaspore, Gibbsite), iron hydroxide (Goethite, Lepidocrocite), manganese hydroxide (Pydrochroite), copper chloride (Nantokite), lead chloride (Cotunnite), silver chloride (Cerargyrite), silver iodide (Jodyrite, Miersite), lead chromate (Crocoite), beryllium silicate (Phenakite), sodium aluminosilicate (Natrolite, Mesolite, Scolecite, Thomasonite), zirconium silicate (Zircon), as well as acmite (Aegirine), brimstone (Sulfur), carborundum (Moissanite), chromspinel (Chromite), epsomsalt (Epsomite), garnet (Almandine, Pyrope, Spessartite), indocrase (Vesuvianite), iron spinel (Hercynite), lithiophyllite (Triphylite), orthite (Allanite), peridote (Olivine), pistacite (Epidote), titanite (Sphene), zinc sulfate, and the like. If desired, the solid light scattering particles can be subjected to a surface treatment process, with either a silane, a titanate, a zirconate coupling agent, or wax encapsulation, to suppress any hydrophilic properties and promote hydrophobic or organophilic properties as well as enhancing physical/chemical interactions of the particles with the matrix material of the hole blocking layer.

Generally, the amount of of light scattering particles utilized in the hole blocking layer depends upon the average size of the particles, the degree of mismatch between the refractive index of dispersed particles and the refractive index of the matrix material of the hole blocking layer, and the thickness of the dried and crosslinked hole blocking layer. Sufficent light scattering particles should be present to effectively scatter the radiation energy which reaches the hole blocking layer so that substantially no incident radiation is reflected back into the overlying layers.

Any suitable chemically reactive film forming material such as hydroxyalkylcellulose, hydroxy alkyl methacrylate polymer, hydroxy alkyl methacrylate copolymer and mixtures thereof, having inherent hole blocking capability, may be utilized to formulate the blocking layer matrix. The expression "chemically reactive film forming material", as employed herein, is defined as a film forming polymer having reactive groups capable of reacting with reactive groups of the organosilane, and may also on the mineral particles, to form a co-crosslinked three dimensional network. Typical chemically reactive groups on the film forming and hole blocking polymers include, for example, hydroxy functional groups, alkoxy functional groups, carbonyl functional groups, and the like. The film forming and hole blocking polymers may be blended with other compatible materials that may or may not having inherent hole blocking properties to form the hole blocking material matrix. If a non hole blocking material is to be used for blending with a film forming and hole blocking polymer, the amount present in the resulting hole blocking layer should be less than about 15 weight percent by weight based on the film forming component of the blocking layer to ensure good hole blocking capability. Since the dispersed particles generally have no hole blocking capabilty, effective hole blocking capacity to stop hole injection from the ground plane during electrophotographic imaging proccesses depends upon factors such as the thickness of the hole blocking layer and the specific film forming hole blocking matrix material selected.

A preferred hydroxyalkylcellulose film forming and hole blocking polymer component for the hole blocking layer coating composition of this invention is a commercially available non-ionic cellulose ether. A typical hydroxyalkylcellulose is available as hydroxypropylcellulose or KLUCEL® from Hercules Incorporated. Others, including hydroxyethylcellulose, modified hydroxyethylcellulose, carboxymethyl hydroxyethylcellulose, as well as methylhydroxyethylcellulose and methylhydroxypropylcellulose, are also available from Hercules Incorporated. KLUCEL® is prepared by reacting alkali cellulose with propylene oxide at elevated temperature and pressure. The propylene oxide can be substituted on the cellulose through an ether linkage at the three reactive hydroxyl groups present on each anhydroglucose monomer unit of the cellulose chain. It is believed that etherification takes place in such a way that hydroxypropyl substituent groups contain almost entirely secondary hydroxyl groups. The secondary hydroxyl present in the side chain is available for further reaction with the oxide, and chaining out may take place. This results in formation of side chains containing more than one mole of combined propylene oxide. It is probable that most of the primary hydroxyl groups on the cellulose have been substituted and that the reactive groups remaining are secondary hydroxyl groups. Some typical molecular weight values are H-type 1,000,000; G-type 300,000; L-type 100,000; and E-type 60,000. An idealized structure of a hydroxyalkylcellulose molecule is shown below:

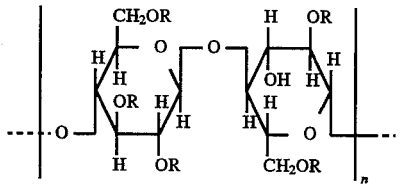

wherein R is independently selected from the group consisting of hydrogen and a substituted or unsubstituted group selected from the group consisting of an alkyl group containing 1 to 20 carbon atoms, a hydroxyalkyl group containing 1 to 20 carbon atoms, an hydroxyether group containing 1 to 20 carbon atoms and an aminoalkyl group containing 1 to 20 carbon atoms, and n is the number of cellulose repeating units from 1 to 3,000. A preferred cellulosic material for the blocking layer of this invention is a hydroxyalkylcellulose compound and derivatives thereof having a degree of substitution of up to 3 molar substitutions of the hydroxyl group of the cellulose per monosaccharide unit and having a weight average molecular weight between about 700 and about 2,000,000. The abundant hydroxy functional groups of the hydroxypropylcellulose are incorporated into a crosslinked network with the silane components to form a reaction product layer having improved elasticity, better coating layer uniformity, and no silane reaction product aggregations or coating thickness variation problems that can occur when hole blocking layers containing only silane are dried by heating.

An unmodified hydroxy alkyl methacrylate film forming and hole blocking polymer that can be employed as component of the hole blocking layer coating composition of this invention is shown in the generalized molecular formula below:

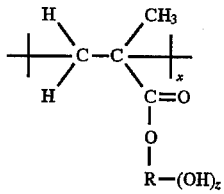

wherein:

x represents sufficient repeat units for a weight average molecular weight between about 400,000 and about 5,000,000, R is a divalent group selected from the group consisting of a linear or branched saturated aliphatic hydrocarbon group containing 1 to 6 carbon atoms and a linear or branched saturated cycloaliphatic hydrocarbon group containing 1 to 6 carbon atoms, and z contains from 1 to 6 hydroxyl groups Typical high molecular weight unmodified hydroxy alkyl methacrylate polymers include poly(4-hydroxybutyl) methacrylate, poly(3-hydroxypropyl)methacrylate, poly(2,3-dihydroxypropyl)methacrylate, poly(2,3,4-trihydroxybutyl)methacrylate, poly(2-hydroxyethylmethacrylate), poly(2-hydroxypropylmethacrylate) and the like. These unmodified hydroxy alkyl methacrylate polymers are, in general, water insoluble and particularly insoluble organic coating solvents utilized in subsequently applied coatings. These polymers attract about one weight percent by weight water and retain much of the trapped water in a dense hydrogen bonded network even at low RH. The trapped water assists in the transport of photodischarged electrons through the blocking layer to the conductive layer and also assists in preventing electron trapping and $V_R$ cycle-up. The higher the hydroxy alkyl methacrylate blocking layer polymer molecular weight, the higher the intermolecular H-bonding density and retentive trapping of water at low RH, and the greater the effectiveness as a solvent barrier (to prevent solvent wash away of the blocking layer).

The presence of the ester group along with a hydroxyl group in each polymeric repeat unit not only maximizes intermolecular H-bonding in the form of OH—OH H-bonding and carbonyl (of the ester) —OH-bonding, but also allows for some intramolecular (5, 6 and 7 membered rings) H-bonding to maintain overall H-bonding density particularly in those blocking layer areas where intermolecular H-bonding is below the average, presumably because of conformationally unfavorable chain configurations. Thus, this intramolecular mode of H-bonding along with trapped water can maintain high H-bonding density which assists electron transport and completes photodischarge to yield low residual voltage $V_R$. All of these properties contribute to the enhanced photoreceptor electrical performance.

The water insoluble high molecular weight hydroxy alkyl methacrylate polymer may be crosslinked and uncrosslinked. If crosslinked, crosslinking may be effected by any suitable difunctional (or higher polyfunctionality)

compound (usually a small molecule) that can react with hydroxyl groups at temperatures of less than about 135° C. to crosslink the hydroxy ester polymer through the hydroxyl groups. Higher temperatures may be utilized if the substrate is not adversely softened at the reaction temperatures.

Any suitable technique may be utilized to crosslink hydroxy alkyl methacrylate polymers through the hydroxyl groups. Generally, if catalysts are employed with the polyfunctional compounds, care should be taken to wash out the catalyst and avoid catalytic residues in the final blocking layer which might adversely affect electrical properties. Similarly, other permanent non-volatile residues which might interfere with the desired final electrical properties of the blocking layer should be avoided. This also ensures that there is no undesirable residue that could migrate out of the blocking layer or which could function as an electron trap in the blocking layer. The expression "unmodified" as employed herein is defined as an uncross-linked hydroxy alkyl methacrylate polymer comprising about the same number of hydroxy alkyl methacrylate repeat units in the hydroxy methacrylate monomer(s) that underwent conversion to polymer, or a hydroxy alkyl methacrylate cross-linked polymer having a decreased number of hydroxyl groups in the hydroxy alkyl methacrylate repeat units versus the hydroxy alkyl methacrylate monomer(s) that underwent conversion to the polymer wherein the decrease is based exclusively on the hydroxyl groups consumed in the cross-linking process. Thus, if a polymer is modified, a chemical grouping is attached to the unmodified polymer as a pendent group that is not capable of cross-linking with itself or other repeat units in the modified polymer.

Satisfactory results may be achieved with water insoluble high molecular weight unmodified hydroxy alkyl methacrylate polymers having a weight average molecular weight of at least about 300,000, the upper limit being limited by the viscosity necessary for processing (generally about 5,000,000). Preferably, the weight average molecular weight is between about 600,000 and about 5,000,000. Optimum blocking layer performance is obtained when the weight average molecular weight is between about 950,000 and about 5,000,000. When the weight average molecular weight is less than about 300,000, the hydroxy alkyl methacrylate blocking layer becomes less effective as a barrier layer thereby allowing unwanted migration of electroconductive layer species into the blocking layer and subsequently coated layers, and the hydroxy alkyl methacrylate blocking layer also becomes less effective as an electron transporting material because of a lower level of water entrapment therein especially at low RH. These low molecular weight deficiencies result in inferior cyclic electrical properties in the form of $V_0$ cycle down and $V_r$ cycle-up. $T_g$ or glass transition temperature has no known effect on the ability of a hole blocking layer of this invention to function effectively.

Optimum results are achieved with the water insoluble high molecular weight unmodified hydroxy alkyl methacrylate polymer poly(2-hydroxyethylmethacrylate) which is represented by the following formula:

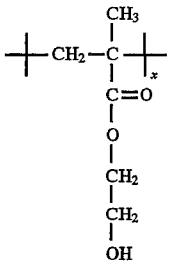

wherein x represents sufficient repeat units for a weight average molecular weight between about 300,000 and about 5,000,000.

Another preferred vinyl hydroxy ester polymer is poly(2-hydroxypropylmethacrylate) which is represented by the following formula:

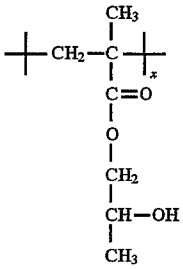

wherein x represents sufficient repeat units for a weight average molecular weight between about 300,000 and about 5,000,000.

The water insoluble high molecular weight unmodified hydroxy alkyl methacrylate polymers of this invention may be blended with other miscible water insoluble high molecular weight unmodified hydroxy methacrylate compatible polymers to provide a blended blocking layer of this invention. Typical miscible water insoluble high molecular weight unmodified hydroxy methacrylate polymers include poly(2-hydroxyethyl methacrylate), poly(2-hydroxypropyl methacrylate), poly(4-hydroxybutyl)methacrylate, poly(3-hydroxypropyl)methacrylate, poly(2,3-dihydroxypropyl) methacrylate, poly(2,3,4-trihydroxybutyl)methacrylate and the like. Miscibility is defined as a non-hazy coating (after drying) of equal amounts of the two copolymers cast from common solution of the two copolymers in one solvent. These are all random (not blocked) copolymers, but block copolymers prepared by group transfer polymerization (GTP) may also be used when prepared at the high molecular weights previously defined for satisfactory, preferred and optimum blocking layer compositions. These polymers are capable of forming dense OH—OH and ester group-OH H-bonding sites which are sufficiently numerous to prevent large domain phase separation. The blended water insoluble high molecular weight unmodified hydroxy alkyl methacrylate polymers may be blends of homopolymers, copolymers or terpolymers or blends of some or all of the above or may have as many different repeat units as desired providing that all the repeat units are derived from unmodified hydroxy alkyl methacrylate monomers capable of being polymerized to water insoluble high molecular weight polymers. The mole percent of each hydroxy alkyl methacrylate repeat unit in the copolymer should be chosen so as to provide the maximum solvent barrier properties to solvents used to apply subsequent photoreceptor layers thereby minimizing deleterious interlayer mixing which leads to unsatisfactory cyclic electrical properties. The specific composition selected for the ground plane will influence the thickness of the hole blocking layer selected. Generally, non-metallic or oxidizable charge injection ground plane materials require a thicker hole blocking layer. Other hydroxy alkyl methacrylate polymer derivatives, such as the copolymer poly(2-hydroxyethyl methacrylate)-poly(methyl acrylamido glycolate methyl ether) [HEMA] or copolymer poly(2-hydroxyethyl methacrylate)-poly(2-hydroxypropyl methacrylate) are also within the scope of the present invention.

Any suitable hole blocking material may be blended with the film forming and hole blocking polymers described above. Hole blocking materials are well known in the art. Typical hole blocking materials include, for example, polyurethanes, polyamides, polyamide-imides, polyaminoacids, polyvinyl butyral, Luckamide, Elvamide, nylon, gelatin, proteins, and the like and mixtures thereof. If these hole blocking materials are added to the film-forming hydroxyalkylcellulose, hydroxy alkyl methacrylate polymer or hydroxy alkyl methacrylate copolymer, the amount added should be less that about 10 percent by weight based on the total weight of the film forming material in the hole blocking layer to avoid phase separation due to incompatibility.

Any suitable organosilane capable of chemically reacting with the hydroxyalkylcellulose, hydroxy alkyl methacrylate polymer or hydroxy alkyl methacrylate copolymer may be used in the charge blocking layer of this invention. A preferred organosilane is a hydrolyzable organoaminosilane. The preferred organoaminosilane for the hole blocking layer is capable of formation of chemical bonds with the oxidized metal surface of a conductive substrate or a conductive ground plane as well as chemically reacting with film forming materials having reactive groups such as the hydroxyalkylcellulose, hydroxy alkyl methacrylate polymer or hydroxy alkyl methacrylate copolymer described above to co-crosslink these components into a three dimensional network structure. More specifically, the preferred organoaminosilane component for the hole blocking layer coating composition of this invention comprises a hydrolyzable organoamino silane which preferably reacts with the reactive film forming component in the hole blocking layer. The hydrolyzable organoaminosilane may be represented by the following formula:

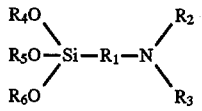

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. The organoaminosilane is hydrolyzed in an aqueous solution with or without the other components of the charge blocking layer of this invention at a pH between about 4 and about 10. Typical hydrolyzable silanes include 3-aminopropyl triethoxy silane, (N,N-dimethyl 3-amino) propyl triethoxysilane, N,N-dimethylaminophenyl silane, N-phenyl aminopropyl trimethoxy silane, triethoxy silylpropylethylene diamine, trimethoxy silylpropylethylene diamine, trimethoxy silylpropyldiethylene triamine, N-aminoethyl-3-aminopropyltrimethoxysilane, N-2-aminoethyl-3-aminopropyltrimethoxysilane, N-2-aminoethyl-3-aminopropyltris(ethylethoxy)silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-proprionate, (N,N'-dimethyl 3-amino)propyl triethoxysilane, N,N-dimethylaminophenyltriethoxy silane, trimethoxysilylpropyldiethylenetriamine and mixtures thereof. The preferred organoaminosilane materials are 3-aminopropyltriethoxysilane, N-aminoethyl-3-aminopropyltrimethoxysilane, (N,N'-dimethyl 3-amino) propyltriethoxysilane, and the like or mixtures thereof because the hydrolyzed solutions of these materials exhibit a greater degree of basicity and stability and because these materials are readily available commercially.

The hydrolyzed organoaminosilane solution may be prepared by adding sufficient water to hydrolyze the hydrolyzable groups attached to the silicon atom to form a solution. During hydrolysis of the organoaminosilanes, the hydrolyzable groups such as alkoxy groups are replaced with hydroxyl groups. Insufficient water will normally cause the hydrolyzed silane to form an undesirable gel. Generally, dilute solutions are preferred for achieving thin coatings. Satisfactory reaction product films may be achieved with solutions containing from about 0.01 percent by weight to about 5 percent by weight of the silane based on the total weight of the solution. A solution containing from about 0.05 percent by weight to about 3 percent by weight silane based on the total weight of solution are preferred for stable solutions which form uniform reaction product layers. It is critical that the pH of the solution of hydrolyzed silane be carefully controlled to obtain optimum effects as on curing as well as electrical stability. A solution pH between about 4 and about 10 is preferred. Optimum reaction product layers are achieved with hydrolyzed silane solutions having a pH between about 7 and about 8, because inhibition of cycling-up and cycling-down characteristics of the resulting treated photoreceptor are maximized. Cycling-down may occasionally be tolerable with hydrolyzed amino silane solutions having a pH less than about 4.

Control of the pH of the hydrolyzed silane solution may be effected with any suitable organic or inorganic acid. Typical organic and inorganic acids include acetic acid, citric acid, formic acid, hydrogen iodide, phosphoric acid, hydrofluorsilicic acid, p-toluene sulfonic acid and the like.

A typical hole blocking layer coating solution of the present invention, comprising between about 1 percent and about 16 percent by weight of hole blocking polymer and organoaminosilane in acetic acid, water, and alcohol along with the dispersion of ultrafine light scattering particles, gives satisfactory results. The acetic acid is added to neutralize the organoaminosilane and adjust the pH of the solution; water is used to provide hydrolysis reaction of the silane; and the alcohol serves as the solvent medium for the coating solution. A preferred hole blocking layer coating solution may contain about 3 percent to about 10 percent by weight of dissolved polymer/silane materials. However, the optimized polymer/silane content in the coating solution is between about 4 percent and about 8 percent by weight based on the total weight of the solution. To determine the exact amounts of acid and water to be added to a specific solution formulation, a 100 gram optimized hole blocking solution comprising 4 grams of 1 part poly(2-hydroxyethyl methacrylate) to 1 part gamma aminopropyltriethoxy silane weight ratio, 0.6 grams acetic acid, 8 grams distilled water, and 87 grams Dowanol®, plus 0.4 gram of light scattering amorphous silica dispersion in the solution is cited here to serve as an example of hole blocking solution preparation to illustrate that the relative amounts of acetic acid and water for all the coating solutions should be based on the amount of silane used in the coating solution in accordance with the weight ratio of acid/silane and water/silane described in the example, to ensure a complete hydrolysis reaction as well as to control the pH of the resulting coating solution. When applied over the surface of a titanium coated polyethylene terephthalate supporting substrate, using a 1.5 mil gap bar by hand coating, followed by drying at 135° C. for 5 minutes in an air circulating oven, the solution in the example described above yields a 1.0 micrometer (10,000 Angstroms) thick hole blocking layer of this invention containing the chemical reaction product of 1 part of poly(2-hydroxethyl methacrylate) to 1 part of gamma aminopropyltriethoxy silane weight ratio, and a 10 percent amorphous silica dispersion based on the weight of the matrix material. The preferred polymer:silane weight ratio is between about 9:1 and about 1:9, with optimum results being obtained with a weight ratio at about 1:1 based on coating layer quality considerations.

Typical combinations of reactive components for a hole blocking film forming material and a hole blocking organosilane to form a hole blocking matrix include, for example, hydroxyalkylcellulose and organoaminosilane; hydroxy methacrylate polymer (which may be a homopolymer, a copolymer, a terpolymer or the like) and organosilane such as poly(2-hydroxyethyl methacrylate) and organoaminosilane, or poly(2-hydroxyethyl methacrylate)-poly(methyl acrylamido glycolate methyl ether) copolymer and organoaminosilane, or poly(2-hydroxyethyl methacrylate)-poly(2-hydroxypropyl methacrylate) copolymer and organoaminosilane; and the like. These film forming materials are preferred for chemically reacting with the organoaminosilane because they inherently possess good hole blocking capabilities, are readily soluble in polar solvents used for organosilane coating solution preparation and are capable of forming a smooth and uniform coating layer. The resulting hole blocking layer forms an electronic barrier to prevent injection of holes into the adjacent photoconductive layer from the underlying conductive layer.

An optional hole blocking layer component comprises a hydrolyzable organometallic chelate compound chemically reacted with the other components of the hole blocking layer of this invention described above. The hydrolyzable organometallic chelate compound can be selected from the group consisting of compounds represented by the following formulae:

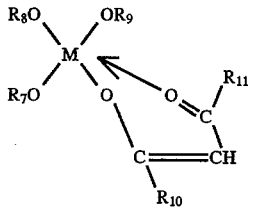

wherein

M is a metal atom selected from the group consisting of zirconium and titanium, and $R_7$, $R_8$, and $R_9$ are independently selected from alkyl groups containing one to six carbon atoms and $R_{10}$ and $R_{11}$ are selected from lower alkyl groups containing one to three carbon atoms, and

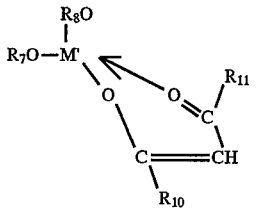

wherein

M' is an aluminum atom, $R_7$ and $R_8$ are independently selected from alkyl groups containing one to six carbon atoms and $R_{10}$ and $R_{11}$ are selected from lower alkyl groups containing one to three carbon atoms.

A hydrolyzable organozirconium compound is hydrolyzed in an aqueous solution with or without the other components of the hole blocking layer of this invention at a pH between about 4 and about 10. Typical hydrolyzable organozirconium compounds include monoacetyl acetonate zirconium tributoxide (e.g. ORGATICS ZC-540, available from Matsumoto Kosho Co.), ethyl acetoacetate zirconium trialkoxide, lactic acid zirconium trialkoxide, and the like. Typical hydrolyzable organotitanium compounds include monoacetyl acetonate titanium tributoxide, ethyl acetoacetate titanium trialkoxide, lactic acid titanium trialkoxide, and the like. Typical hydrolyzable organoaluminate compounds include diisobutyl (oleyl) aceto acetyl aluminate, diisopropyl (oleyl) aceto acetyl aluminate, and the like.

An optimized hole blocking layer coating solution, containing dispersed light scattering particles, comprises between about 1.5 percent and about 3.5 percent by weight hydroxyalkylcellulose, between about 9.8 percent and about 9.6 percent by weight organosilane, and between about 88.7 percent and about 86.9 percent by weight of an organozirconium, organotitanium or organoaluminate compound, based on the total weight of solutes in the coating solution. The coating solution also contains between about 0.650 percent and about 0.647 percent by weight water, between about 56.4 percent and about 56.3 percent by weight isopropyl alcohol, between about 28.3 percent and about 28.2 percent by weight n-butanol, based on the total weight of the hole blocking layer coating solution. Since these solution formulations contain adequate amounts of organic polar solvents and a small quantity of water to promote the hydrolysis reaction, they also promote wetting of the metal oxide layer of metallic conductive anode layers. Improved wetting ensures achievement of greater uniformity of the coating layer thickness as well as a crosslinking reaction between the hydrolyzed silane, hydroxyalkylcellulose, hydrolyzed organozirconium or organotitanium compound and metal oxide layer. Any suitable polar solvent additive may be employed. Typical polar solvents include methanol, ethanol, isopropanol, n-butanol, tetrahydrofuran, methylcellosolve, ethylcellosolve, ethoxyethanol, ethylacetate, ethylformate and mixtures thereof. Optimum wetting is achieved with a mixture of isopropyl alcohol and n-butanol as the organic polar solvent additive. Generally, the amount of polar solvent added to the hydrolyzed organosilane solution is less than about 95 percent based on the total weight of the solution for best results.

Since each coating solution formulation of this invention contains an organic polar solvent, a small amount of acid to control the pH, and a small quantity of water to promote the hydrolysis reaction, the solution also promotes wetting of the metal oxide layer of metallic conductive anode layers (ground plane). Improved wetting ensures achievement of greater uniformity in coating layer thickness as well as the crosslinking reaction between the hydrolyzed silane, polymer, metal oxide layer of the conducting ground plane, and amorphous silica or mineral paricles. Any suitable polar solvent additive may be employed. Typical polar solvents include methanol, ethanol, isopropanol, n-butanol, tertiary butyl alcohol, 1-methoxy-2-hydroxy propane, tetrahydrofuran, methylcellosolve, ethylcellosolve, ethoxyethanol, ethylacetate, ethylformate and mixtures thereof. Optimum wetting is achieved with a mixture of isopropyl alcohol and n-butanol as the organic polar solvent additive. Where a hydrolyzed silane solution is employed, the amount of polar solvent generally added, is less than about 95 percent based on the total weight of the solution for best results.

The hole blocking layer solution may be deposited on the metal oxide surface of a substrate by any suitable technique. Typical application techniques include spraying, dip coating, draw bar coating, gravure coating, silk screening, air knife coating, reverse roll coating, and the like. The hole blocking layer coating solutions of this invention are especially desirable for dip coating processes. For obtaining relatively thick hole blocking layers free of cracking, the blocking layers are preferably applied by dip coating substrates such as drums in a coating solution, with the solvent being removed after deposition of the coating by conventional techniques such as by vacuum, heating and the like. Generally, for dip coating, a weight ratio of hole blocking layer solutes to solvents of between about 1:6 and about 1:5 is satisfactory where the solutes weight ratio of a hydroxyalkylcellulose weight to the total weight of other solutes is between about 1:60 and about 2:55.

Drying or curing of the hole blocking layer coating upon the metal oxide layer should be conducted at a temperature greater than about room temperature to provide a chemical reaction product layer having more uniform electrical properties, more complete conversion of the reactants and less unreacted components. Generally, a reaction temperature between about 100° C. and about 150° C. is preferred for maximum conversion, adhesion and avoidance of coating layer cracking. The temperature selected depends to some extent on the specific metal oxide layer utilized and can also limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

The reaction time depends upon the reaction temperatures used. Thus, less reaction time is required when higher reaction temperatures are employed. Generally, increasing the chemical reaction time increases the degree of cross-linking of the reactants. Satisfactory results have been achieved with reaction times between about 0.5 minute to about 45 minutes at elevated temperatures. For practical purposes, sufficient cross-linking is achieved by the time the chemical reaction product layer is dry provided that the pH of the aqueous solution is maintained between about 4 and about 10. The reaction may be conducted under any suitable pressure including atmospheric pressure or in a vacuum. Less heat energy is required when the reaction is conducted at sub-atmospheric pressures.

One may readily determine whether sufficient condensation reaction in the cross-linking process has occurred in the coating to form a network structure having stable electrical, chemical and mechanical properties for the final electrophotographic imaging member to withstand the operating conditions in a machine environment, by merely washing the dried coating with water, toluene, tetrahydrofuran, methylene chloride or cyclohexanone and examining the washed coating to compare infrared absorption of Si—O-wavelength bands between about 1,000 to about 1,200 $cm^{-1}$. If the Si—O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer and the other components of the charge blocking layer. The chemical reaction of hydrolyzed silane with metal hydroxide molecules in the pores of the metal oxide layer is described in U.S. Pat. No. 4,464,450 to L. A. Teuscher, the disclosure of which is incorporated herein in its entirety.

The hole blocking layer of the present invention, having a dispersion of light scattering particles, should be continuous and have a thickness of greater than about 0.5 micrometer because thinner hole blocking layer coatings may not provide proper dispersion of the particles and can cause particle protrusions beyond the hole blocking layer surface. Satisfactory results may be achieved with a hole blocking layer thickness of between about 0.5 micrometer and about 5 micrometers, because a smooth uniform coating layer is formed which provides complete ground plane/substrate surface coverage and good photoelectrical performance. A thickness of between about 1 micrometer and about 2 micrometers is the optimum condition for hole blocking layers to achieve most desirable electrical behavior. After drying, a chemical reaction product is formed involving the organoaminosilane; hydroxyalkylcellulose, hydroxy alkyl methacrylate polymer or hydroxy alkyl methacrylate copolymer; optional organozirconium or organotitanium or organoaluminum chelate compound; and the metal oxide on the underlying conductive surface. This reaction product enhances the adhesive bond strength of the charge blocking layer and provides an improved light scattering effect as well.

A hole blocking layer of this invention containing sufficient dispersed particles should be continuous and have an uniform thickness of at least about 0.5 micrometer. Dispersed particles in hole blocking layer coatings thinner than about 0.5 micrometer may produce insufficient light scattering for suppressing plywood fringes, may cause excessive particle protrusions at the surface of the resulting coating layer, and may also fail to provide complete film coverage of the conductive substrate thereby leading to the formation of undesirable bare spots at the surface of the substrate, particularly for rough surfaced drum substrates coated by dip coating techniques. A hole blocking layer thickness of between about 0.5 micrometer and about 5 micrometers is satisfactory to achieve complete ground plane/substrate surface coverage, prevent hole injection from the ground plane after the electrophotographic imagewise exposure step, yield the desired electrical performance, and render sufficient light scattering to suppress formation of plywood fringes. A thickness of between about 0.7 micrometer and about 3 micrometers is particularly preferred. However, it has been found that a hole blocking layer thickness of between about 1 micrometer and about 2 micrometers leads to the best coating layer quality and provides the resulting imaging member with optimum photo-electrical performance including production of excellent printed copies. A particle dispersion content between about 3 percent and about 80 percent by weight, based on the total dried weight of the hole blocking layer of this invention, achieves satisfactory suppression of reflection fringes in a fabricated electrophotographic imaging member. A dispersion of between about 5 percent and about 50 percent by weight based on the total weight of the dried blocking layer is preferred. Optimum results are achieved when the particle loading level is between about 10 percent and 30 percent by weight. To provide effective hole blocking capabilities, it is also important that the hole blocking layer of this invention have an electrical resistivity between about $10^3$ ohm-cm and and about $10^{12}$ ohm-cm. A resistivity of less than $10^3$ ohm-cm will result in a large amount of electrical cycle-down whereas an electrical resistivity greater than $10^{12}$ ohm-cm can be too electrically insulating. When the layer is too insulating, a substantial background voltage rise occurs during the electrophotographic image cycling process. For optimum results, an electrical resistivity between about $10^7$ ohm-cm to about $10^{10}$ ohm-cm is desirable The hole blocking layer solution may be deposited on the metal oxide surface of a substrate by any suitable technique. Typical application techniques include spraying, dip coating, draw bar coating, gravure coating, silk screening, air knife coating, reverse roll coating, and the like. The hole blocking layer coating solutions of this invention are desirable for both webs and dip coating processes. For obtaining relatively thick hole blocking layers in drum electrophotographic imaging members, the blocking layers are preferably applied by dip coating substrates such as drums in a coating solution, with the solvent being removed after deposition of the coating by conventional techniques such as by vacuum, heating and the like.

Drying or curing of the invention hole blocking layer coating upon the metal oxide layer should be conducted at a temperature greater than about room temperature to provide a reaction product layer having more uniform electrical properties, more complete conversion of the reactants and less unreacted components. Generally, a reaction temperature between about 100° C. and about 150° C. is preferred for maximum conversion, adhesion, and elasticity. The temperature selected depends to some extent on the specific metal oxide layer utilized and is limited by the temperature sensitivity of the substrate. Reaction product layers having optimum electrochemical stability are obtained when reactions are conducted at temperatures of about 135° C. The reaction temperature may be maintained by any suitable technique such as ovens, forced air ovens, radiant heat lamps, and the like.

One may readily determine whether sufficient condensation reaction in the cross-linking process has occurred in the charge blocking layer matrix to form a network structure having stable electrical, chemical and mechanical properties for the final electrophotographic imaging member to withstand the operating conditions in a machine environment, by merely washing the dried coating with water, toluene, tetrahydrofuran, methylene chloride or cyclohexanone and examining the washed coating to compare infrared absorption of Si—O-wavelength bands between about 1,000 to about 1,200 $cm^{-1}$. If the Si—O-wavelength bands are visible, the degree of reaction is sufficient, i.e. sufficient condensation and cross-linking has occurred, if peaks in the bands do not diminish from one infrared absorption test to the next. It is believed that the partially polymerized reaction product contains siloxane and silanol moieties in the same molecule. The expression "partially polymerized" is used because total polymerization is normally not achievable even under the most severe drying or curing conditions. The hydrolyzed silane appears to react with metal hydroxide molecules in the pores of the metal oxide layer and the other components of the charge blocking layer. The reaction of hydrolyzed silane with metal hydroxide molecules in the pores of the metal oxide layer is described in U.S. Pat. No. 4,464,450 to L. A. Teuscher, the disclosure of which is incorporated herein in its entirety.

Uniformly charged imaging members containing the hole blocking layer of this invention may be exposed with monochromatic activating radiation having a wavelength between a lower limit of about 600 and an upper limit of about 800 nm to form an electrostatic latent image on the imaging member. This latent image is developed with toner particles using conventional techniques to form a toner image corresponding to the latent image. The toner image is transferred to a receiving member by any suitable well known processes The hole blocking layer of this invention has sufficient light scattering capacity to remove both the entering radiation and the back reflection, if any, from the conductive metal ground plane. Thus the present invention eliminates the light reflection component from the metallic ground plane by a light scattering effect achieved by means of an improved hole blocking layer located directly above the conductive ground plane. The successful resolution of the reflection interference fringes problem by providing the improved light scattering hole blocking layer of this invention does not appear to adversely affect the photoelectrical integrity of the original electrophotographic imaging member. The charge blocking layer of the present invention also extends mechanical service life of electrophotographic imaging members while simultaneously reducing plywooding type defects in image output prints during imaging with coherent light radiation.

The present invention is far superior than those disclosed in the prior art such as those utilizing a light absorbing substrate, or a light scattering rough substrate, or a light absorbing anti-curl backing layer, or a light scattering anti-curl blocking layer. Some of the reasons for this superiority include the following:

1. Since electrophotographic imaging members, in either a flexible belt or rigid drum configuration, usually employ a highly reflective metallic coating over a plastic substrate support or a highly reflective metallic support material, the hole blocking layer of this invention applied directly over the metal/substrate support can more effectively prevent the light energy from passing through it as well as capturing the back reflection, if any, from the ground plane metal surface of the substrate support.
2. The use of a light absorbing substrate or a light absorbing (or light scattering) anti-curl backing layer requires that the conductive ground plane be absolutely optically transparent in order to yield good results, an unusual condition that is difficult to satisfy.
3. Since an anti-curl backing layer is not required for rigid drum electrophotographic imaging members, light absorbing or a light scattering anti-curl layers are applicable only to flexible imaging belts. However, the hole blocking layer of the present invention can be conveniently utilized for flexible imaging belts as well as for rigid imaging drums.

4. The use of a light scattering substrate such as a toughened surface substrate utilized for flexible imaging webs, as disclosed in a prior art, has a propensity for causing scratches to form in the thin metal ground plane and thin hole blocking layers containing organosiloxanes. This is due to the winding, unwinding, and rewinding steps employed during the electrophotographic imaging web coating/manufacturing processes. These scratches manifest themselves as print-out defects in final copies.
5. Commercially available roughened flexible substrates are usually loaded with a high concentration of fillers and have low optical transmittance which render back exposure erase of imaging members extremely difficult to accomplish during electrophotgraphic imaging processes.
6. Thin blocking layers employed in conventional imaging members, such as organosiloxane blocking layer materials, or organosilane/organometallic chelate compound blends, tend to produce incomplete coating layer coverage over the surface of roughened substrates and leave bare spots often observed in both the flexible web and rigid drum configurations.

The invention will now be described in detail with respect to specific preferred embodiments thereof, it being noted that these examples are intended to be illustrative only and are not intended to limit the scope of the present invention. Parts and percentages are by weight unless otherwise indicated.

COMPARATIVE EXAMPLE I

An electrophotographic imaging member was prepared by providing a titanium coated polyester substrate (Melinex 442, available from ICI Americas, Inc.) having a thickness of 3 mils (76.2 micrometers) and applying thereto, using a ½ mil gap Bird applicator, a solution containing 1 gram gamma aminopropyltriethoxy silane (available from Union Carbide Corporation), 4 grams distilled water, 0.3 gram acetic acid, 74.7 grams of 200 proof denatured alcohol and 20 grams heptane. This layer was then allowed to dry for 5 minutes at 135° C. in a forced air oven. The resulting blocking layer had an average dry thickness of 0.06 micrometer measured with an ellipsometer.

An adhesive interface layer was then prepared by applying, with a ½ mil gap Bird applicator to the blocking layer, a wet coating containing 0.5 percent by weight based on the total weight of the coating solution of a polyester adhesive (MOR-ESTER 49,000, available from Morton International, Inc.) dissolved in a 70:30 volume ratio mixture of tetrahydrofuran/cyclohexanone. The wet coating of the applied adhesive interface layer was allowed to dry for 5 minutes at 135° C. in the forced air oven. The resulting adhesive interface layer had a dry thickness of 0.05 micrometer.

The adhesive interface layer was thereafter coated with a photogenerating layer containing 7.5 percent by volume trigonal Se, 25 percent by volume N,N'-diphenyl-N,N'-bis(3-methylphenyl)-1,1'-biphenyl-4,4'-diamine, and 67.5 percent by volume polyvinylcarbazole. This photogenerating layer was prepared by introducing 8 grams polyvinyl carbazole and 140 mls of a 1:1 volume ratio of a mixture of tetrahydrofuran and toluene into a 20 oz. amber bottle. To this solution was added 8 grams of trigonal selenium and 1,000 grams of ⅛ inch (3.2 millimeter) diameter stainless steel shot. This mixture was then placed on a ball mill for 72 to 96 hours. Subsequently, 50 grams of polyvinyl carbazole and 2 grams of N,N'-diphenyl-N,N'-bis(3-methylphenyl)-1,1'-biphenyl-4,4'-diamine dissolved in 75 ml of 1:1 volume ratio of tetrahydrofuran/toluene. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 3 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in the forced air over to form a dry thickness photogenerating layer having a thickness of 2 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4,4'-diamine and Makrolon 5705, a polycarbonate resin having a molecular weight of from about 50,000 to 100,000 commercially available from Farbensabricken Bayer A.G. The resulting mixture was dissolved to give a 15 percent by weight solid in 85 percent by weight methylene chloride. This solution was applied onto the photogenerator layer. The approximately 3 mm wide strip of about of the adhesive layer left uncoated by the photogenerator layer was co-coated with a ground strip layer during the charge transport layer coating process.

Both the applied charge transport layer and the ground strip wet coatings were dried at 135° C. for 5 minutes in the forced air over to form 24 micrometers and 14 micrometers dried thicknesses, respectively.

An anti-curl coating was prepared by dissolving 8.82 grams of polycarbonate resin (Makrolon 5705, available from Bayer AG) and 0.72 gram of polyester resin (Vitel PE-200, available from Goodyear Tire and Rubber Company) in 90.1 grams of methylene chloride in a glass container to form a coating solution containing 8.9 percent solids. The anti-curl coating solution was then applied to the rear surface (side opposite the photogenerator layer and charge transport layer) of the imaging member with a 3 mil gap Bird applicator and dried at 135° C. for about 5 minutes in the forced air oven to produce a dried film thickness of about 13.5 micrometers. The fabricated electrophotographic imaging member had a structure similar to that schematically shown in FIGS. 3 and 4 and was used as an imaging member control.

COMPARATIVE EXAMPLE II

An electrophotographic imaging member was prepared by following the procedures and using the same materials as described in Comparative Example I, with the exception that the coating of the silane blocking layer was omitted to yield a structurally simplified version of the electrophotographic imaging member of Comparative Example I.

EXAMPLE III

This Example deals with master coating solutions prepared with gamma aminopropyltriethoxy silane and poly(2-hydroxyethyl methacrylate). Using a 100 gram solution as the basis, a 4 percent by weight organoaminosilane master solution was prepared by mixing 4 grams of the silane (available from Union Carbide Corporation), 16 grams of distilled water, and 1.2 grams of acetic acid in a container.

The mixture was allowed to stand for 10 minutes with constant agitation to complete the hydrolysis reaction. The mixture was then diluted with 78.8 grams of Dowanol® PM (1-methoxy-2-hydroxypropane, available from Dow Chemical Company) to form a 4 percent by weight of hydrolyzed silane master solution. A 4 percent by weight master solution of poly(2-hydroxyethyl methacrylate) was also prepared by dissolving 4 grams of poly(2-hydroxyethyl methacrylate) (available from Scientific Polymer Products, and having a weight average molecular weight of $1.2\times10^6$) in 96 grams of Dowanol®.

The reason that poly(2-hydroxyethyl methacrylate) was selected for this Example is because it is a good film forming polymer, readily soluble in polar solvent, and is, by itself, a good hole blocking material. Having abundant hydroxy functional pendant groups in the polymer structure, poly(2-hydroxyethyl methacrylate) can easily be co-crosslinked into a three dimensional network structure with the organoaminosilane through the heating and drying processes. The excess hydroxy groups in the polymer molecule are also highly efficient in prevent hole injection from the ground plane during electrophotographic imaging operations.

EXAMPLE IV

An electrophotographic imaging member was fabricated according to the description of Comparative Example I, except that the application of an organoaminosilane layer was replaced by the hole blocking layer of this invention which was coated from a 4 percent by weight solution prepared by mixing one part of the hydrolyzed gamma aminopropyltriethoxy silane master solution and nine parts of the poly(2hydroxyethyl methacrylate) master solution of Example III plus addition of a predetermined amount of aerosil R812 (a synthetic hydrophobic amorphous fumed silica available from Degusa Corporation) to form a hole blocking solution. The aerosil R812 silica, manufactured by high temperature hydrolysis of a volatile silane compound in an oxygen-hydrogen gas flame, is a spherically shaped primary particle. These primary particles collide and fuse with one another during the pyrogenic process to form branched three-dimensional chainlike secondary particles called aggregates. Thus, aerosil silica does not exist as primarily particles but as aggregates which have an average particle size of approximately 0.3 micrometer. If desired, it is possible to break down the aggregates by high shear mixing into smaller aggregates. The hydrophobic properties of aerosil R812 silica are achieved by a surface treatment process involving reaction of silica particles with hexamethyl disilazane to remove up to 70 percent of the surface hydroxyl groups.

The hole blocking solution was ball milled for 24 hours and then mixed using a high shear dispersing rotor (Tekmer Dispax Disperser) to ensure homogeneous silica dispersion in the hole blocking solution. The applied gamma aminopropyltriethoxy silane/poly(2-hydroxyethyl methacrylate)/silica wet coating, using a 1½ mil gap Bird applicator, over the titanium/polyester substrate was dried at 135° C. for 5 minutes in the forced air oven to yield a 0.55 micrometer dry hole blocking layer thickness of the present invention containing one part of gamma animopropyltriethoxy silane and nine parts of poly(2-hydroxyethyl methacrylate) plus 20 percent by weight of aerosil 300 silica dispersion with respect to the silane/poly(2-hydroxyethyl methacrylate) material matrix. The resulting electrophotographic imaging member is essentially identical to that schematically illustrated in FIG. 5.

EXAMPLE V

An electrophotographic imaging member was fabricated by following the same procedures and using the same materials as described in Example IV, except that the present invention hole blocking layer had a dried thickness of about 1.0 micrometer and comprised equal parts of silane and poly(2-hydroxyethyl methacrylate) plus a 10 percent by weight of aerosil silica dispersion with respect to the silane/poly(2-hydroxyethyl methacrylate) material matrix.

EXAMPLE VI

An electrophotographic imaging member was fabricated according to the description of Example IV, except that the silane/poly(2-hydroxyethyl methacrylate) ratio in the hole blocking layer of this invention was nine parts to one part and had a dried thickness of about 0.50 micrometer. The aerosil silica dispersion was 20 percent by weight with respect to the silane/poly(2-hydroxyethyl methacrylate) material matrix.

COMPARATIVE EXAMPLE VII

A 3-mil biaxially oriented polyethylene terephthalate (polyester) substrate film was vacuum coated with an aluminum layer. The exposed surface of the aluminum layer was oxidized by exposure to oxygen in the ambient atmosphere to form the ground plane. A hole blocking layer solution was prepared by mixing 43.5 grams isopropyl alcohol, 21.8 grams n-butanol, and 0.5 gram distilled water in a glass bottle for 30 minutes prior to the addition of 10 grams monoacetyl acetonate zirconium tributoxide (ORGATICS ZC-540, available from Matsumoto Kosho Co.) and 1.1 grams 3-aminopropyltrimethoxysilane (NUC SILANE A-1110, available from Nihon Unicor Co.). This coating solution was then stirred for 30 minutes and applied over the aluminized polyester substrate by hand coating, using a half mil gap bar, to yield a 0.7 micrometer thick dried charge blocking layer after drying at 135° C. for 5 minutes in an air circulating oven. Examination of the dried blocking layer under 100× magnification with a reflection optical microscope revealed the presence of an extensive network of cracks in the layer. A charge generation layer coating mixture consisting of 97 percent by weight cyclohexanone, 3 percent by weight solids of 75 parts metal free phthalocyanine and 25 parts polyvinyl butyral binder (BMS, available from Sekisui Chemical Co., Ltd.) was applied using a half mil gap bar to give a dried charge generator layer having a thickness of about 1 micrometer after drying at 135° C. for 5 minutes in an air circulating oven. The charge generating layer was then overcoated with a charge transport layer coating solution of 82 percent by weight monochlorobenzene and 18 percent by weight of a dissolved solid mixture of 60 parts 4,4'-cyclohexilidene diphenyl polycarbonate binder having a weight average molecular weight of 40,000 (available from Mitsubishi Chemicals) and 40 parts N,N'-diphenyl-N,N'-bis(3-methylphenyl)-[1,1'-biphenyl]-4,4'-diamine, using a 3-mil gap bar. After drying at 135° C. for 5 minutes, a 24 micrometer thick dried charge transport layer was formed.

An anti-curl coating was then applied, by using identical materials and following the same procedures as described in Comparative Example I, to complete the fabrication of an electrophotographic imaging member of this invention. This electrophotographic imaging member had a structure analogous to that shown in FIGS. 6 and was used as an imaging member control.

EXAMPLE VIII

The same procedures and identical materials described in Comparative Example VII were repeated for fabrication of an electrophotographic imaging member of this invention, except that the isopropanol in the hole blocking layer coating solution was replaced by methanol. Further, a small amount of hydroxypropyl cellulose (KLUCEL HF, available from Hercules Inc.) was added to the coating solution at a solutes weight ratio of hydroxypropyl cellulose to the combination of monoacetyl acetonate zirconium tributoxide and silane of 1:59. A predetermined amount of Cab-O-Sil TS530 (a hydrophillic synthetic, amorphous fumed silica available from Cabot Corporation) dispersion was also included in the solution to complete the coating solution preparation process. Similar to the aerosil silica described in the preceding Examples, Cab-O-Sil TS530 silica has an ultrafine, spherical primary particle diameter of about 80 Angstroms. Like the aerosil silica, it exists only as aggregates of about 0.3 micrometer (3,000 Angstroms) in average particle size. This hole blocking layer solution was first ball milled for 24 hours and then mixed with Dispax Dispenser to ensure homogeneous silica dispersion. This coating solution was applied onto a 3 mil thick aluminized polyester substrate, using a 1.5 mil gap bar. Upon drying at 135° C. for about 5 minutes in the forced air oven, the resulting dried hole blocking layer of the present invention had a dried thickness of about 1.4 micrometers and contained 10 percent by weight Cab-O-Sil silica with respect to the matrix material. Examination of the dried blocking layer under 100× magnification with the reflection optical microscope showed no hole blocking layer cracking.

EXAMPLE IX

The procedures described in Example VIII were repeated for another invention electrophotographic imaging member fabrication using the same procedures and identical materials, with the exception that the hydroxypropyl cellulose added to the coating solution was at a solutes weight ratio of hydroxypropyl cellulose to the combination of monoacetyl acetonate zirconium tributoxide and silane of 2:58. The resulting dried hole blocking layer had a thickness of about 2.8 micrometers and contained 10 percent by weight of Cab-O-Sil silica with respect to the matrix material of the hole blocking layer. Examination of the dried coating layer under 100× magnification with the reflection optical microscope showed no hole blocking layer cracking.

EXAMPLE X

The same procedures and identical materials described in Example VIII were repeated for invention electrophotographic imaging member fabrication, with the exception that the hydroxypropyl cellulose added to the coating solution was at a solutes weight ratio of hydroxypropyl cellulose to the combination of monoacetyl acetonate zirconium tributoxide and silane of 3:57. The resulting dried blocking layer had a thickness of about 3.3 micrometers and contained 8 percent by weight of Cab-O-Sil silica with respect to the matrix material of the hole blocking layer. Examination of the dried coating layer under 100× magnification with the reflection optical microscope showed no hole blocking layer cracking.

EXAMPLE XI

The same procedures and identical materials described in Example X were repeated for fabrication of an electrophotographic imaging member of this invention, with the exception that equal quantity of ultrafine HI-Sil 223 silica (a synthetic, amorphous precipitated silica available from PPG Industries, Inc.) was added to the hole blocking layer solution instead of the Cab-O-Sil fumed silica to form the dispersion. The prepared coating solution was then applied over a 3 mil thick aluminized polyester substrate using a 1.5 mil gap bar. After drying at 135° C. for 5 minutes, the wet coating yielded a dried hole blocking layer of about 3.5 micrometers in thickness and contained 8 percent by weight of HI-Sil 223 silica in the hole blocking matrix material. The precipitated silica is commercially produced by the aciduation of sodium silicate solution with either sulfuric acid or mixture of carbon dioxide and hydrochloric acid or sulfuric acid. Although the HI-Sil 223 silica has a primary spherical shape of about 20 Angstroms, it has an aggregate size of approximately 0.5 micrometer. Examination of the dried coating layer under 100× magnification with the reflection optical microscope showed no hole blocking layer cracking.

EXAMPLE XII

The electrophotographic imaging members of Examples I, II and Examples IV through XI were evaluated for adhesive properties using a 180° peel test method. The 180° peel strength was determined by cutting a minimum of five 0.5 inch×6 inch imaging member test samples from each of these Examples. For each test sample, the charge transport layer was partially stripped from the imaging member test sample with the aid of a razor blade and then had peeled to about 3.5 inches from one end to expose part of the underlying charge generating layer. The test imaging member sample was secured with its charge transport layer surfacing toward a 1 inch×6 inches×0.25 inch aluminum backing plate with the grid of two sided adhesive tape. Under these conditions, the anti-curl layer/substrate of the stripped segment of the test sample could easily be peeled 180° away from the test sample to cause the adhesive layer to separate from the charge generating layer. The end of the resulting assembly opposite to the end from which the charge transport layer was not stripped was inserted into the upper jaw of an Instron Tensile Tester. The free end of the partially peeled anti-curl/substrate strip was inserted into the low jaw of the Instron Tensile Tester. The jaws were then activated at a 1 inch/mn crosshead speed, a 2 inch chart speed, and a load range of 200 grams to peel the test sample at 180° to about 2 inches. The loads monitored with a chart recorder were used to calculate the layer adhesion. The average load required for stripping the anti-curl/substrate layer divided by the width of each test sample gave the peel strength.

To evaluate the effectiveness of silica dispersion in the hole blocking layer of the present invention in suppressing formation of the plywood fringe defects during copy image development, the imaging members of the above Examples were carefully examined for interference fringes formation under a coherent light emitted from low pressure sodium lamp source.

Listed in Tables I and II below are the results obtained from 180° peel strength measurements and interference fringes examination. These results indicate that incorporation of the ultrafine light scattering silica (having refractive index of 1.42) into the matrix material (with a refractive index of 1.58) of a hole blocking layer not only effectively resolved the plywood fringes problem, it was also provided the added benefit of enhancing the adhesion strength of the layer to the other layers in the electrophotographic imaging member of this invention through a filler reinforcement effect.

TABLE I

| EXAMPLE | FILLER CONTENT (%) | PEEL STRENGTH (gms/cm) | PLYWOOD FRINGES |
|---|---|---|---|
| I, Control | 0 | 6.2 | Yes |
| II, Control | 0 | 5.8. | Yes |
| IV, Invention | 20 | 32.9 | No |
| V, Invention | 10 | 35.4 | No |
| VI, Invention | 20 | 34.1 | No |

TABLE II

| EXAMPLE | FILLER CONTENT (%) | PEEL STRENGTH (gms/cm) | PLYWOOD FRINGES | BLOCKING LAYER CRACKING |
|---|---|---|---|---|
| VII, Control | 0 | 4.0 | Yes | Yes |
| VIII, Invention | 10 | 11.6 | No | No |
| IX, Invention | 10 | 18.3 | No | No |
| X, Invention | 8 | 17.9 | No | No |
| XI, Invention | 8 | 19.5 | No | No |

Furthermore, the data in the last column of Table II also show that the generic hole blocking layer cracking problem of the zirconium-silane coating of Comparative Example VII could be totally eliminated by using the hole blocking layer formulations of the present invention as described in Examples VIII through XI.

When tested for photo-electrical integrity using a xerographic scanner, all the electrophotographic imaging members containing the hole blocking layers of the present invention gave charging/discharging properties, field induced dark decay electrical characteristic, and 50,000 cycles of electrical stability equivalent to the results obtained for each respective control imaging member counterpart of Comparative Example I and Comparative Example VI.

It should be emphasized that the structurally simplified control electrophotographic imaging member of Comparative Example II, having no silane blocking layer, exhibited extensive electrical cycle-down (over 50 percent) after 50,000 cycles of testing. This result indicated that the application of an effective blocking layer directly over the metallic ground plane was necessary to eliminate hole injection from the ground plane during electrophotographic imaging processes.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a substrate, a charge blocking layer, an optional interface adhesive layer, a charge generating layer, and a charge transport layer, said blocking layer comprising solid finely divided light scattering inorganic particles having an average particle size between about 0.3 micrometer and about 0.7 micrometer selected from the group consisting of amorphous silica, mineral particles and mixtures thereof, dispersed in a matrix material comprising the chemical reaction product of (a) a film-forming polymer selected from the group consisting of hydroxyalkylcellulose, hydroxy alkyl methacrylate polymer, hydroxy alkyl methacrylate copolymer and mixtures thereof and (b) an organosilane.

2. An electrophotographic imaging member according to claim 1 wherein said blocking matrix material also comprises an organometallic chelate compound selected from the group consisting of an organotitanium chelate compound, an organozirconium chelate compound and an organoaluminum chelate compound.

3. An electrophotographic imaging member according to claim 1 wherein said blocking matrix material is crosslinked into a 3-dimensional network after said chemical reaction.

4. An electrophotographic imaging member according to claim 1 wherein the difference in value of the refractive index of said blocking matrix material and the value of the refractive index of said light scattering particles is between about 0.08 and about 1.5.

5. An electrophotographic imaging member according to claim 1 wherein the difference in value of the refractive index of said blocking matrix material and the value of the refractive index of said light scattering particles is between about 0.1 and about 1.

6. An electrophotographic imaging member according to claim 1 wherein the difference in value of the refractive index of said blocking matrix material and the value of the refractive index of said light scattering particles is between about 0.15 and about 0.8.

7. An electrophotographic imaging member according to claim 1 wherein said organosilane is an amino organosilane.

8. An electrophotographic imaging member according to claim 7 wherein said amino organosilane is gamma amino propyl triethoxysilane.

9. An electrophotographic imaging member according to claim 1 wherein said inorganic light scattering particles have an average particle size of between about 0.3 micrometer and about 0.7 micrometer.

10. An electrophotographic imaging member according to claim 1 wherein said inorganic light scattering particles comprise amorphous silica particles.

11. An electrophotographic imaging member according to claim 1 wherein said inorganic light scattering particles comprise mineral particles.

12. An electrophotographic imaging member according to claim 1 wherein said inorganic light scattering particles is selected from the group consisting of hydrophillic and hydrophobic particles.

13. An electrophotographic imaging member according to claim 1 wherein said blocking layer has a thickness between about 0.5 micrometer and about 5 micrometers.

14. An electrophotographic imaging member according to claim 1 wherein said blocking layer has a thickness between about 1 micrometer and about 2 micrometers.

15. An electrophotographic imaging member according to claim 1 wherein said blocking layer comprises between about 3 percent and about 80 percent by weight of said particles based on the total weight of said layer.

16. An electrophotographic imaging member according to claim 1 wherein said blocking layer comprises between about 10 percent and about 30 percent by weight of said particles based on the total weight of said layer.

* * * * *